US007963499B2

(12) United States Patent
Fitzgerald et al.

(10) Patent No.: US 7,963,499 B2
(45) Date of Patent: Jun. 21, 2011

(54) FORMLINER AND METHOD OF USE

(75) Inventors: Edward Daniel Fitzgerald, Laguna Beach, CA (US); Brian Eugene Sheehan, Mission Viejo, CA (US)

(73) Assignee: Prime Forming & Construction Supplies, Inc., Santa Ana, CA (US)

( * ) Notice: Subject to any disclaimer, the term of this patent is extended or adjusted under 35 U.S.C. 154(b) by 0 days.

(21) Appl. No.: 12/238,294

(22) Filed: Sep. 25, 2008

(65) Prior Publication Data

US 2010/0071308 A1 Mar. 25, 2010

(51) Int. Cl.
*E04G 11/36* (2006.01)

(52) U.S. Cl. ..... 249/16; 249/15; 249/83; 249/189; 249/192; 425/318; 425/385; 425/458; 425/470

(58) Field of Classification Search ..... 425/470, 425/318, 385, 458, 469, 110, 299; 249/15, 249/16, 189, 83; 264/293, 294, 33, 297.9
See application file for complete search history.

(56) References Cited

U.S. PATENT DOCUMENTS

| | | | | | |
|---|---|---|---|---|---|
| 1,564,578 | A | * | 12/1925 | Kennedy | 264/33 |
| 2,616,145 | A | * | 11/1952 | Dufford | 249/15 |
| 3,096,195 | A | * | 7/1963 | Seman et al. | 264/163 |
| 3,664,630 | A | * | 5/1972 | Maynen et al. | 249/112 |
| 3,678,887 | A | * | 7/1972 | Smith | 118/504 |
| 3,692,458 | A | * | 9/1972 | Kirsch | 425/469 |
| 4,026,083 | A | | 5/1977 | Hoyt et al. | |
| 4,695,033 | A | | 9/1987 | Imaeda et al. | |
| 4,773,790 | A | * | 9/1988 | Hagenah | 404/41 |
| 4,858,410 | A | | 8/1989 | Goldman | |
| 4,888,928 | A | | 12/1989 | Rea et al. | |
| 5,002,817 | A | * | 3/1991 | Jones | 428/159 |
| 5,487,526 | A | * | 1/1996 | Hupp | 249/2 |
| 5,887,846 | A | * | 3/1999 | Hupp | 249/2 |
| 6,041,567 | A | | 3/2000 | Passeno | |
| 6,857,248 | B2 | | 2/2005 | Ouellet et al. | |
| 2005/0064128 | A1 | * | 3/2005 | Lane et al. | 428/44 |
| 2006/0157634 | A1 | * | 7/2006 | Nasvik | 249/16 |
| 2006/0180731 | A1 | * | 8/2006 | Scott et al. | 249/15 |
| 2007/0217865 | A1 | * | 9/2007 | Castonguay et al. | 404/41 |
| 2009/0100774 | A1 | * | 4/2009 | Fasching et al. | 52/391 |

OTHER PUBLICATIONS

International Search Report and Written Opinion received in corresponding PCT Application No. PCT/US2009/058489, mailed Feb. 10, 2010, 14 pages.

* cited by examiner

*Primary Examiner* — Joseph S Del Sole
*Assistant Examiner* — Timothy Kennedy
(74) *Attorney, Agent, or Firm* — Knobbe Martens Olson & Bear, LLP

(57) ABSTRACT

A formliner and method of use are provided in order to minimize and/or eliminate visible seaming between interconnected formliners. In some embodiments, the formliner can comprise raised sections that define interrelated inner and outer dimensions. In this manner, a given portion of a first formliner can mate with another given portion of a second formliner in a nested manner. As such, edges of the interconnected formliners can be discreetly hidden along features of the formliner pattern to reduce and/or eliminate visible seaming between the formliners.

21 Claims, 16 Drawing Sheets

FORMLINER AND METHOD OF USE

BACKGROUND

1. Field of the Inventions

The present inventions relate generally to concrete formliners and methods of using the same. More specifically, the present inventions relate to an improved formliner that reduces and/or eliminates visible seams in order to create a more natural appearance in a finished product.

2. Description of the Related Art

Decorative masonry and concrete construction have become increasingly popular in recent years. The facades of homes and other buildings that had previously been constructed in very simple and plain concrete are now being replaced with either decorative stone and brick or decorative concrete construction.

As a result of the increased demand for stone and brick work, various improvements have been made in stone and brick masonry and concrete construction. These improvements have lowered the cost for such construction by decreasing the time or skill requirements previously needed to perform such work.

For example, in stone and brick masonry, facings and floors have traditionally constructed by skilled artisans from individual units. However, recent advances have been made in the masonry art which allow artisans to more quickly and accurately perform stone or brick work. In particular, various panels, forms, and mounting systems have been developed that allow individual units to be placed in precise geometric patterns, thus eliminating much of the painstaking effort usually expended by the artisan. This now allows generally unskilled artisans, such as the do-it-yourselfer, to create a high-quality product.

Perhaps more importantly for projects with a tighter budget, advances in concrete construction now allow artisans to create a faux stone or brick appearance in concrete with a formliner. As a result, one may achieve the appearance of stone or brick without the associated cost.

A concrete formliner generally comprises an interior surface onto which concrete is poured. The interior surface of the formliner typically includes a desired pattern or shape that will be transferred to the exposed surface of the concrete to form a cured concrete casting. In many cases, the formliner is lined up with additional formliners to create a pattern over a wide area. The concrete casting can be created in a horizontal (such as for tilt up construction) or vertical casting process, and can be pre-cast, or cast-at-site construction.

After the concrete has cured, the formliners are removed from the exposed surface of the concrete, thus revealing the desired pattern or shape. Such patterns or shapes can include faux stone or brick, wave patterns, emblems, etc.

SUMMARY

As noted above, in recent years, significant advances have been made in the art of concrete laying. Various techniques and equipment have been developed that allow for the creation of decorative patterns in the concrete, especially a faux stone or brick appearance. The results of such techniques and equipment provide the appearance of stone or brick without the cost.

However, according to at least one of the embodiments disclosed herein is the realization that in using multiple formliners, seams are created between the formliners where the formliners meet. For example, in order to create a large pattern or casting with prior art formliners, the formliners are merely placed together using butt joints, thus creating significant visible seams between the formliners. As a result, the appearance of the exposed surface of the concrete is compromised. An unsightly seam is very easy to notice and takes a substantial amount of time and effort to remove from cured concrete. Further, in large-scale projects, it is simply too cost prohibitive to re-work the cured concrete in order to remove the seams. As such, the seams are simply left in place resulting in an inferior concrete product.

Accordingly, in at least one embodiment disclosed herein, an improved formliner is provided which minimizes and/or eliminates the seams between multiple interconnected formliners. One of the advantages of embodiments disclosed herein is that a seam between adjacent formliners is created along corners at or along a bottom portion of a prepared formliner assembly or mold cavity of a casting. For example, in some embodiments, a seam between adjacent and/or interconnected formliners can be formed by an edge of a first formliner positioned against or in a corner or face of an adjacent second formliner. In some embodiments, the seam can lie along the intersection of one or more surfaces, such as at a corner of a mold or formwork. Additionally, in other embodiments, the seam can be positioned such that the weight of a curable material, such as concrete, against the formliners causes the formliners to be pressed against each other with greater force thereby minimizing and/or eliminating the seam between the adjacent formliners.

As discussed herein, embodiments of the formliner can also be referred to as a sheet or panel. Some embodiments of the formliner can define interconnecting portions such that multiple formliners can be overlaid with each other at the interconnecting portions thereof. Optionally, the interconnecting portions of the formliner can define variable geometries.

For example, a given interconnecting portion of the formliner can nest within another given interconnecting portion of the formliner. In such embodiments, as well as in other embodiments disclosed herein, the formliner can be configured such that upper surfaces of the interconnected formliners are flush with each other and joints between the interconnected formliners are minimized. Thus, embodiments disclosed herein can achieve a natural appearance of faux stone and brick with minimized, negligible, or imperceptible seaming.

In accordance with some embodiments, the formliner can comprise interlocking portions configured to overlap when the formliner is interconnected with another formliner such that seams between the interconnected formliners run along an edge or corner of the interconnected formliners. In this manner, the seams between interconnected formliners can be masked among discontinuities in a surface. Thus, the seams can be further concealed from view.

Additionally, in accordance with at least one embodiment disclosed herein, the formliner can comprise a plurality of cells. Optionally, the cells can be rectangularly shaped, thus taking on the appearance of bricks. The cells can be arranged in an offset pattern. In this regard, the formliner can be interconnected with another formliner to produce a finger jointed pattern in the concrete. Additionally, the cells can be shaped in the form of various types of stone. The stone shapes may be rounded, thin, square, and in other myriad shapes. Embodiments of the formliner can be formed to include cells that are identical or that very in size. Optionally, embodiments of the formliner can comprise one or more cells that define a substantially planar face. Alternatively, the formliner can comprise one or more cells that define a roughened or textured face.

In an embodiment, a formliner is provided for use in creating a decorative pattern on a treated or exposed face of a curable material. Embodiments can be used in horizontal or vertical casting. Some embodiments can be used with materials such as cement, plaster, or other such curable materials. In other embodiments, the formliner can comprise a sheet of material, at least one cell, and at least one rib. This material can optionally be formed from a plastic material. The cell can be formed in the sheet of material. The rib can extend along the cell and form a boundary of the cell. The rib can be formed in the sheet of material and define a raised profile.

In some embodiments, the rib can comprise a first section, a second section, at least one opening, and a transition zone. The first section can define an exterior surface and an interior surface. The exterior surface of the first section of the rib can be configured to face outwardly toward the cementitious material. The first section can define a recess adjacent to the interior surface thereof. The recess can define a cross-sectional interior profile.

The second section can define an exterior surface forming a cross-sectional exterior profile. The cross-sectional exterior profile of the second section can be less than the cross-sectional interior profile of the first section. The opening can be formed in the first section.

The transition zone can be formed in the rib between the first section in the second section to interconnect the first section with the second section. The transition zone can define a variable cross-sectional profile increasing from the cross-sectional exterior profile of the second section to the cross-sectional interior profile of the first section.

It is contemplated that a first formliner can be interconnected with a second formliner by nesting the overlaying the first section of the rib of the first formliner onto the second section of the rib of the second formliner such that the second section of the rib of the second formliner is nested within the first section of the rib of the first formliner. Further, exterior surfaces of the ribs of the first formliner and the second formliner can be flush with each other upon nesting of the second section of the second formliner within the first section of the first formliner. Additionally, an opening in the first section of the first formliner can mate against a transition zone of the second formliner such that visible seams in the decorative pattern are minimized when the first formliner and the second formliner are interconnected in use.

In some embodiments, the ribs of the first formliner and the second formliner can be arcuately shaped. The opening formed in the first section of the rib can extend from a base of the rib to an apex of the rib. The rib can be arcuately shaped and the opening can be curvilinear. Further, a rib edge formed along the opening in the first section of the first formliner can abut the transition zone of the second formliner. The rib and the cell can meet to form a corner.

Further, the first section of the rib of the first formliner can define a peripheral edge. The peripheral edge of the first section of the rib can be disposed along a corner formed by the intersection of the rib and the cell of the second formliner along the second section of the rib of the second formliner. The peripheral edge of the first section of the rib can be generally straight. The formliner can comprise a plurality of cells with a plurality of ribs disposed intermediate the cells to form boundaries thereof. The cells can define a generally rectangular shape. The cells can define opposing narrow ends. Further, the cells can be arranged in a plurality of layers with each layer having a plurality of cells disposed end-to-end.

In other embodiments, the cells of a first layer can also be offset from the cells of a second layer. Further, the formliner can comprise a plurality of cells and define a first end and a second end. In this regard, the first end can be formed to include a first finger joint pattern and the second end can be formed to include a second finger joint pattern that is complementary to the first finger joint pattern such that a first end of the first formliner can be overlaid with a second end of the second formliner.

In accordance with yet another embodiment, a panel is provided for forming a repeated pattern on a rigid surface. The panel can comprise a plurality of cells and a panel periphery. The plurality of cells can be configured to receive material to be applied to the surface and can be arranged in rows with the cells of each row being offset with respect to cells of an adjacent row. The panel periphery can bound the plurality of cells by a plurality of sides. Each cell can comprise a recess portion for receiving the material and being shaped to confer a pattern on the material. In this regard, at least one given side of the panel periphery can be formed with cells in offset configuration such that the given side has at least one row with a projecting cell bounded in at least one adjacent row with a non-projecting cell. In some embodiments, the cells can be uniformly sized. For example, the cells can be rectangular.

Additionally, in accordance with another aspect of the present inventions, a set of panels can be provided which comprises a first panel as claimed in Claim 14 and a second panel. The second panel can have a panel periphery with at least one side being formed with cells in offset configuration such that the side has at least one row with a projecting cell bounded in at least one adjacent row with a non-projecting cell. The first and second panels can be configured to interconnect along the sides thereof having the projecting cells. The projecting cell of the first panel can be positioned in the same row as the non-projecting cell of the second panel and can be offset from the projecting cell of the second panel. The projecting cell of the second panel can be positioned in the same row as the non-projecting cell of the first panel. The first and second panels can form a continuous sheet with offset cells along their juncture. As mentioned above, in some embodiments, the cells can be uniformly sized. For example, the cells can be rectangular.

In accordance with yet another embodiment, a sheet is provided for forming a pattern on a surface of a cementitious material. The sheet can comprise rows of recesses. Each recess can be shaped to impart the pattern to the surface of the material. The recesses in a given row can be offset with respect to the recesses in an adjacent row. Each recess can be surrounded with ridges defining the recess. The sheet can be combinable with a similar sheet by means of overlapping at least some of the ridges. In this regard, a plurality of sheets can be interconnected at their ends to form a junction along ridges of offset recesses such that the sheets are interconnected without a substantial seam at the junction.

In yet another embodiment, a panel is provided for imparting a decorative appearance to a surface, such as a casting (whether horizontal or vertical), a wall, walking area or the like through application of a curable material to the surface that shaped to the decorative appearance by a series of recesses. The recesses can be configured to receive the curable material and provide the decorative appearance as the curable material cures. The recesses can have projections defining a first dimension. The panel can have first and second edge areas configured to allow a plurality of panels to be interconnected along the first and second edges areas in an end-to-end manner. The first edge area of the panel can define first projections having an underside. The second edge area of the panel can have, at least in part, second projections of a reduced dimension for mating with the underside of the first projections of another panel by overlaying the first projections of the panel on the second projections of reduced dimension.

In accordance with another embodiment, a panel is provided for forming a pattern in a curable material. The panel can comprise a series of shaped regions for imparting, when curable material is in the regions, the pattern on a wall or the like. The panel can be formed with the shaped regions each being bounded by ridges. The ridges of the panel can be configured to enable the panel to be engageable with another panel to increase the area of application of the pattern. Further, at least one of the ridges of the panel can have an open end to allow the ridges of the panel to overlay at least one of the ridges of the other panel.

Additionally, the panel can be optionally configured to define a perimeter and the ridges can extend about the perimeter thereof. The panel can comprise overlapped ridges and overlapping ridges. This regard, the overlapping ridges of the panel can comprise one or more open ends such that ridges of the other panel can be overlapped by the overlapping ridges of the panel and extend from the open end in the overlapping ridges of the panel. In some implementations, the overlapping ridges can define an interior dimension that is greater than an exterior dimension of the overlapped ridges. In other embodiments, the shaped regions of the panel can be formed in generally rectangular shapes and the panel can define a perimeter comprising one or more ridges having an open end at a corner of the perimeter of the panel.

In accordance with yet another embodiment, a method is provided for transferring a decorative pattern to an exposed surface of a curable material. The method comprise the steps of: providing a plurality of formliners, each formliner comprising one or more shaped regions being bounded by ridges, each formliner defining overlapped ridges and overlapping ridges; engaging a first formliner with a second formliner by overlaying overlapping ridges of the first formliner on to overlapped ridges of the second formliner; and placing the curable material against the first and second formliners to transmit a decorative pattern formed by the shaped regions of the first and second formliners onto the exposed face of the curable material.

In some embodiments, each formliner can further comprise non-overlap ridges and at least one open end formed in the overlapping ridges. In this regard, the method can further comprise overlaying the overlapping ridges of the first formliner onto the overlapped ridges of the second formliner with a non-overlap ridge of the second formliner extending from an open end of the overlapping ridges of the first formliner. Further, the non-overlap ridge of the second formliner can be interconnected with and extends from the overlapped ridge of the second formliner.

Additionally, the overlapping ridges of the first formliner can define an interior geometry that is greater than an exterior geometry of the overlapped ridges of the second formliner. In such embodiment, the method can further comprise engaging a third formliner with the first formliner and the second formliner. The third formliner can comprise overlapping ridges and overlapped ridges, and one of the first, second, and third formliners can comprise a sub-overlapped ridge section. The sub-overlapped ridge section can define an exterior geometry that is less than an interior geometry of the overlapped ridges, the method further comprising overlaying an overlapped ridge on to the sub-overlapped ridge section.

Further, in some embodiments, the first formliner can be configured with the sub-overlapped ridge section formed along a corner of a periphery of the first formliner. Further, the second formliner and the third formliner can overlapped the first formliner at the sub-overlapped ridge section of the first formliner.

In other implementations of the method, the first formliner and the second formliner can each comprise at least one row with a projecting cell bounded in at least one adjacent row with a non-projecting cell. The first formliner and the second formliner can be engaged with a projecting cell in a first row of the first formliner being positioned adjacent to a non-projecting cell in a first row of the second formliner and a projecting cell in a second row of the second formliner being positioned adjacent to a non-projecting cell in a second row of the first formliner.

Furthermore, some embodiments of the method can allow for minimized and/or eliminated seaming between the formliners. For example, the overlapping ridges of the first formliner can be configured to include edges that extend downwardly toward a bottom portion of respective shaped regions located adjacent to overlapped ridges of the second formliner. The method can comprise placing the curable material against the overlapping ridges of the first formliner such that the edges of the overlapping ridges of the first formliner are urged adjacent to the bottom portion of respective shaped regions to minimize and/or eliminate a seam formed between the edges and the bottom portion of the respective shaped regions.

In accordance with some embodiments, it is contemplated that the formliner can be attached to another formliner and/or to a form work by means of an adhesive. Such an adhesive can be applied to the formliner at the site. However, in some embodiments, the formliner can comprise an adhesive that can be activated or exposed in order to enable adhesive attachment of the formliner to another formliner or to a form work. For example, the adhesive can be pre-applied to the formliner, which adhesive can be exposed by removing a strip or by dampening with a liquid such as water or otherwise. In this manner, the formliner can be securely attached in a pattern and/or in a form work to facilitate handling and placement of the formliner.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENTS

Figure 1:
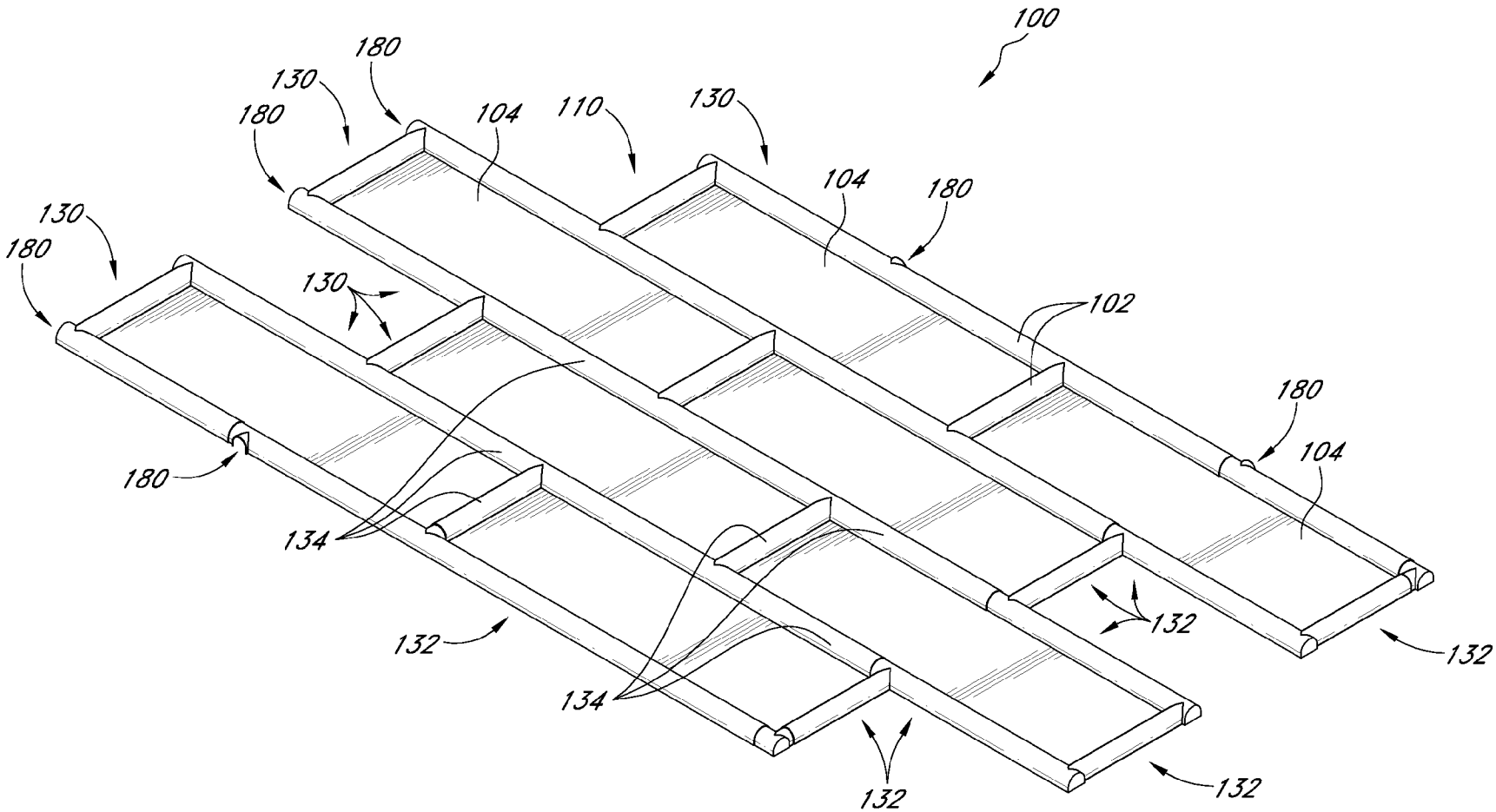
FIG. 1 is a perspective view of a formliner, according to an embodiment of the present inventions.

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein.

As generally discussed above, embodiments of the present inventions are advantageously configured in order to enhance the aesthetic finish of a concrete structure. In particular, embodiments disclosed herein can be used to create a natural, seamless appearance of brick, stone, and other types of materials in a concrete structure.

In contrast to prior art formliners that produce an inferior quality product, the structures of embodiments of the formliner disclosed herein, which can also be referred to as a panel or sheet, allow the formliner to create decorative patterns that are visually superior to results provided through the prior art. These significant advantages are due at least in part to the nesting arrangement of the variable size channels of embodiments of the formliner disclosed herein. In particular, the formliner can comprise one or more large interconnection sections and one or more small interconnection sections such that a plurality of formliners can be interconnected at their respective large and small interconnection sections. When interconnected, the plurality of formliners can define one or more generally continuous dimensions or shapes of raise portions thereof. For example, the large and small interconnection sections can configured as nesting semi-cylinders that form a rib structure. Additional advantages and features of embodiments of the formliner are discussed further below.

In some embodiments, it is contemplated that the formliner can be attached to another formliner and/or a form work by means of an adhesive. The adhesive can be disposed on a rear surface or back of the formliner and/or onto a front surface of the formliner. For example, the adhesive can be disposed on the front surface along a rib or ridge that will be overlaid by a portion of another formliner.

In some embodiments, the adhesive can be applied to the formliner at the site. For example, the adhesive can be applied or sprayed onto the formliner. However, in other embodiments, the formliner can comprise an adhesive that can be activated or exposed in order to enable adhesive attachment of the formliner to another formliner or to a form work. In such embodiments, the adhesive can be pre-applied to the formliner and can be exposed by removing a cover strip or activated by dampening with a liquid such as water or otherwise. As such, by peeling away a cover strip or by providing moisture to the adhesive, the adhesive can be activated to adhesively attach the formliner to another formliner or to a form work. As noted above In this manner, the formliner can be securely attached another formliner in a pattern and/or to a form work to facilitate handling and placement of the formliner.

Embodiments of the formliner and formliner components disclosed herein can be manufactured using any of a variety of processes. For example, it is contemplated that some embodiments can be formed using a sheet and a vacuum forming operation. Other manufacturing processes such as injection molding, stamping, extrusion, etc. can also be used.

With reference now to the figures, FIG. 1 is a perspective view of an embodiment of a formliner, panel, or sheet 100. The formliner 100 can comprise a plurality of ribs, ridges, or channels 102. The ribs 102 can be a raised portion of the formliner 100. The ribs 102 can define an outer perimeter of the formliner 100. Additionally, the ribs 102 can extend inwardly to form one or more cells or recesses 104.

In some embodiments, the cells 104 can comprise a recessed portion of the formliner 100. The recessed portion of the cell 104 can be configured to receive a curable material to which a pattern of the formliner can be conferred or transferred. The cells 104 can be uniformly sized. For example, the cells 104 can be rectangularly shaped. As discussed below, embodiments of the formliner 100 can implement other shapes, depths, and sizes of the cells 104.

As illustrated in the embodiment of FIG. 1, the cells or recesses 104 can be arranged in rows. As will be discussed further below, the cells or recesses 104 of a given row can be offset with respect to cells or recesses of an adjacent or neighboring row. In this regard, a plurality of formliners 100 can be interconnected along ends thereof in such a way as to reduce any visible appearance of a seam between interconnected formliners. The offset configuration of the cells or recesses 104 in some embodiments can aid in concealing or hiding any seaming between formliners.

Additionally, the embodiment illustrated in FIG. 1 illustrates that the cells 104 of adjacent rows can be offset from each other such that at opposing ends of the formliner 100, some of the cells 104 protrude at the end. In this regard, the rows can be formed to include projecting and non-projecting cells 104. The projecting cells can be considered to be complete or whole cells. In other words, the projecting cells are not smaller in size than other cells 104 of the pattern even though the offset configuration of the cells 104 causes the projecting cells to protrude at one side or end of the formliner 100. As will be discussed further below, the projecting cells of the pattern can be interconnected with projecting cells of another formliner.

The embodiment illustrated in FIG. 1 can be used to create a faux brick pattern on a concrete structure. The formliner 100 can define a panel periphery bounding the plurality of cells 104 by a plurality of sides. The formliner 100 defines an upper surface 110. Although not shown in FIG. 1, the formliner 100 also defines a lower surface. In use, the upper surface 110 of the formliner 100 would be positioned such that it can be pressed into fresh concrete. This can be accomplished by placing the upper surface 110 of the formliner 100 against an exposed surface of fresh concrete. Otherwise, this can be accomplished by affixing the lower surface of the formliner 100 to an interior wall of a pattern, casting, or formwork before concrete is poured into the pattern, casting, or formwork. In either case, a material, such as concrete can be placed against the decorative pattern of the formliner 100 defined by the ribs 102 and the cells 104 in order to transfer the decorative pattern to the exposed surface of the material as the material cures.

In many cases, the exposed surface of a given structure, such as a wall, walking area, or the like, consists of a large surface area. In order to cover the entire area, several formliners must be used. As shown in the formliner assembly of FIG. 2, several formliners 120, 122, and 124 can be interconnected in order to transfer a decorative pattern onto a large surface area. The interconnection of these formliners 120, 122, and 124 provides a distinct advantage over prior art to formliners because the seams between the formliners 120, 122, and 124 are insubstantial and/or eliminated compared to prior art formliners.

As discussed above, FIG. 2 illustrates that the formliner 120 can comprise projecting cells 125 in the formliner 122 can comprise one or more projecting cells 126. These projecting cells 125, 126 can be positioned in different rooms of the formliners 120, 122. Thus, the projecting cells 125 can be positioned adjacent to non-projecting cells of the formliner 122 in the projecting cell 126 can be positioned adjacent to a non-projecting cell of the formliner 120. Thus, the cells of the formliner 120 can be offset with respect to each other and with respect to cells above the formliner 122. Moreover, the interconnection of the formliners 120, 122 can be accomplished using offset projecting cells 125, 126.

Figure 2:
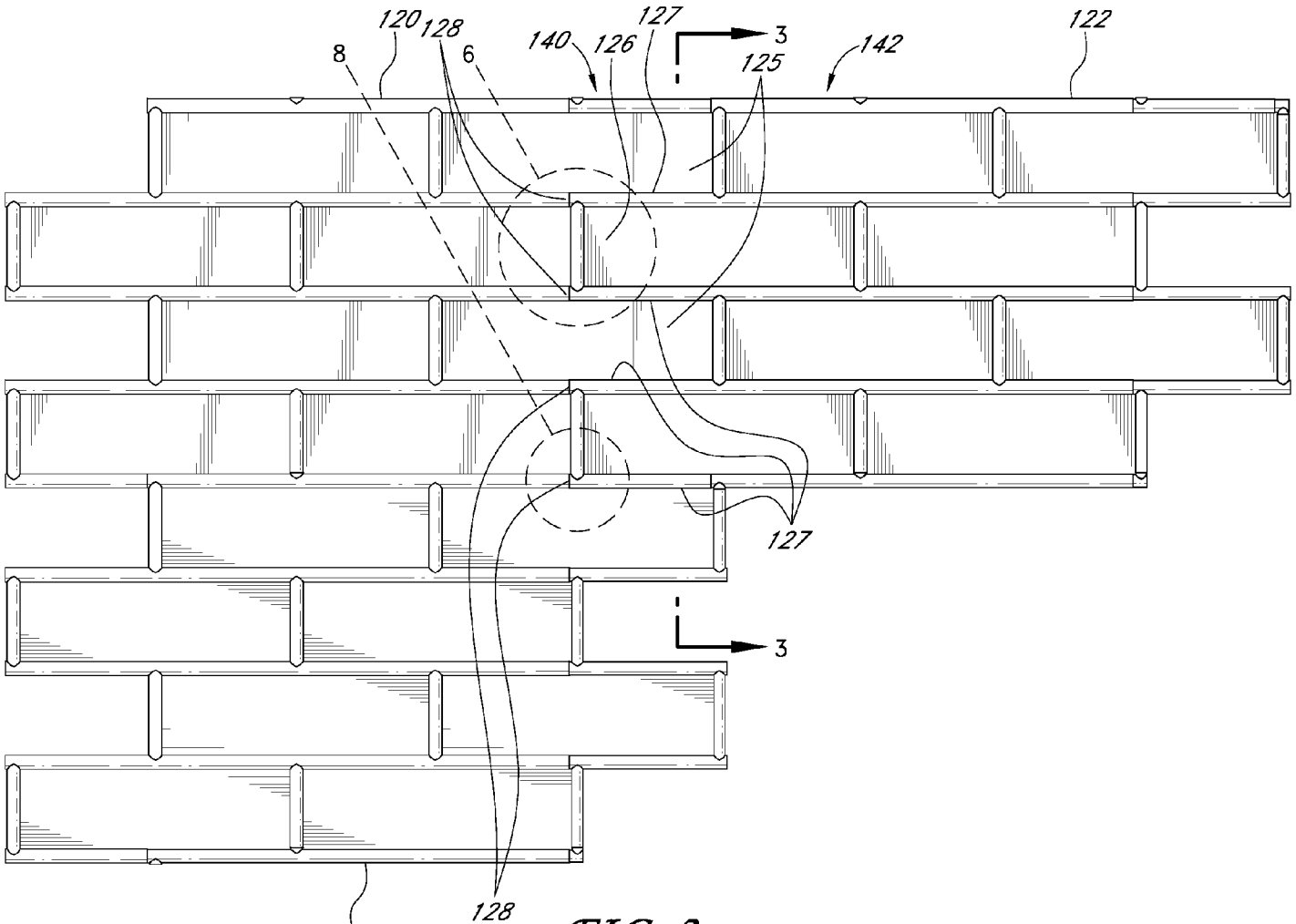
FIG. 2 is a top view of a plurality of formliners that are interconnected to create a formliner assembly, according to an embodiment.

In accordance with some embodiments, the formliner 100 illustrated in FIG. 1 can be configured such that a plurality of formliners 100 can be interconnected at their top and bottom ends and sides. FIG. 2 illustrates this principle. The formliners 120, 122, and 124 are each interconnected and overlap each other. This interconnection allows the formliners to be easily handled and assembled to a given size. Importantly however, the formliner is configured such that portions thereof can overlap and create a generally uniform and seamless rib structure on the upper surface 110 of the formliners 120, 122, and 124. In other words, the shape and depth of the rib structure formed in the exposed surface of the concrete structure can be generally constant and the transition from a given formliner to another given formliner can be generally imperceptible.

Moreover, in some embodiments, edges of each of the respective formliners 120, 122, and 124 can lie along a corner or edge feature of the decorative pattern. As such, when a curable material is placed in against the formliners and takes the shape, in this case of a rectangle having right-angle corners, an edge 127 of the formliner 122 forms a portion of the corner of the molded or formed rectangle and becomes nearly imperceptible. Accordingly, the overlapping edges 127 of the formliner 122 create minimal visible seaming, if at all, between the formliners 120 and 122. This principle is illustrated in greater detail in FIGS. 6-9.

Additionally, transition zones or joints 128 are formed where upper surfaces of ribs the formliners 120, 122, and 124 meet. In this regard, the transition zones or joints 128 can be toleranced in order to define an extremely narrow gap between interconnected formliners. Thus, any seaming at the transition zones or joints 128 can also be greatly reduced in order to reduce and/or eliminate visible seaming.

In this regard, the formliner 100 can be configured such that the plurality of ribs 102 includes one or more overlapping portions 130 and one or more overlapped portions 132. In some embodiments, the plurality of ribs 102 of the formliner 100 can be configured to comprise one or more non-overlap portions 134. The overlapping portions 130 can be configured to include an internal cavity with an internal geometry that accommodates the external geometry of the overlapped portions 132. Thus, the overlapped portions 132 can be received within the internal cavities of the overlapping portions 130. The non-overlap portions 134 can extend between overlapping portions 130 and overlapped portions 132. However, the non-overlap portions 134 will not overlap or be overlapped by portions of another formliner win a plurality of formliners are interconnected. When a plurality of formliners is interconnected, the external surface of the overlapping portions 130 can be flush with the external surface of the non-overlap portions 134.

Figure 3:
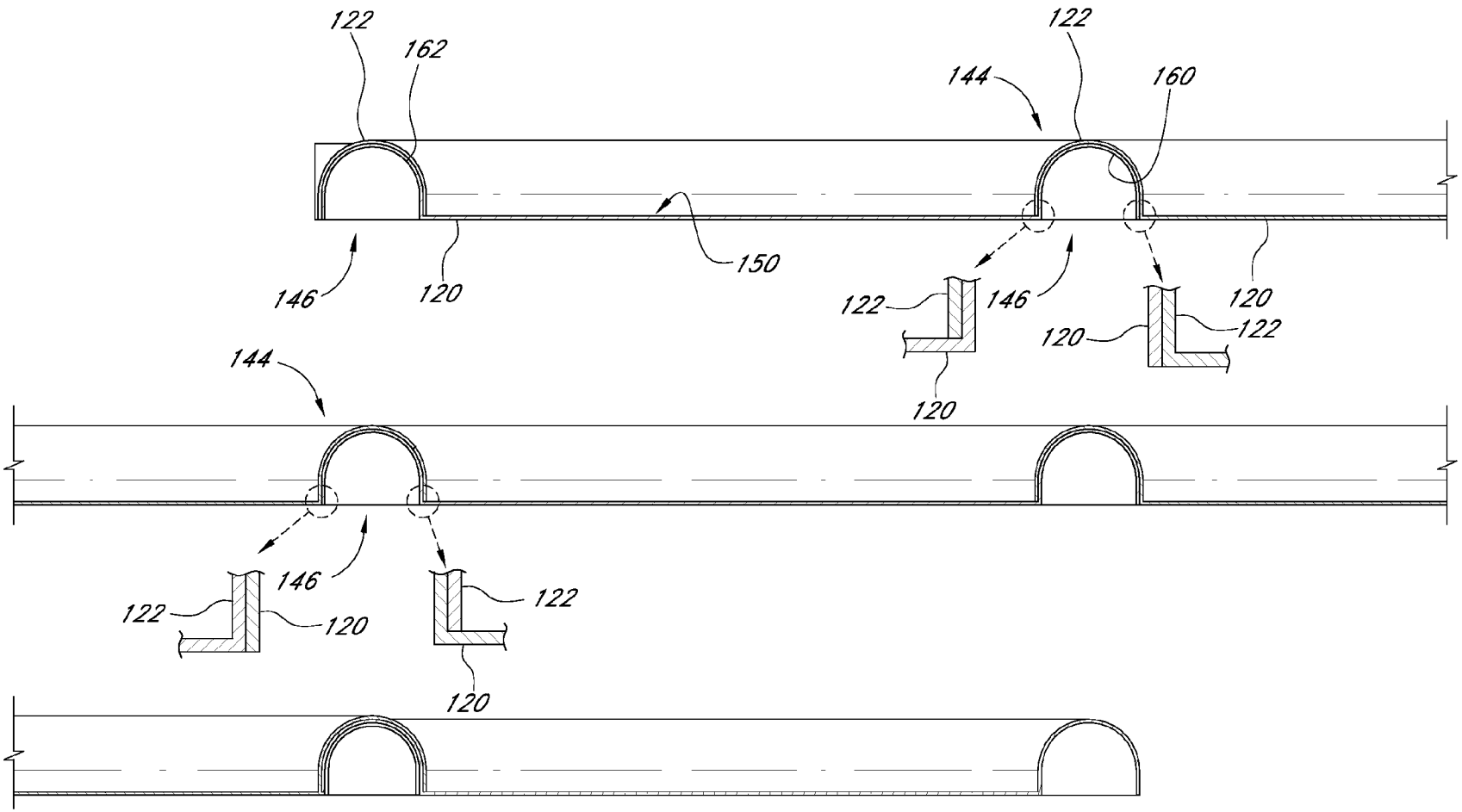
FIG. 3 is a cross-sectional side view taken along section 3-3 of FIG. 2.

An illustration of this principle is shown in FIGS. 3 and 7B and described below. FIG. 3 it is a cross-sectional side view taken along Section 3-3 of FIG. 2. FIG. 2 illustrates that a right side 140 of the formliner 120 overlaps with a left side 142 of the formliner 122.

In FIG. 3, an overlapping portion 144 of the formliner 122 rests on top of an overlapped portion 146 of the formliner 120. The cross-sectional side view also illustrates a cell 150 of the formliner 120. Further, the formliners 120, 122 are configured such that the overlapping portion 144 of the formliner 122 defines an outer surface that matches an outer surface of the ribs 102 of the formliners 120, 122, and 124. In other words, the overlapping portions of a formliner can have an outer dimension that is equal to an outer dimension of the non-overlap portions of the ribs of the formliner. Thus, the overall rib structure of interconnected formliners will seem continuous in shape and dimension because the overlapping portions and the non-overlap portions (and not the overlapped portions) of the ribs of the formliners are the only portions of the ribs that are exposed.

In addition, as discussed below with regard to FIG. 10, one of the significant advantages of embodiments disclosed herein is that they are able to reduce and/or eliminate seams between adjacent formliners using the significant compressive stresses created by the weight of a curable material, such as concrete, poured onto a formliner assembly or formliner mold cavity. In other words, the configuration of the overlapped and overlapping portions of adjacent formliners enabled the weight of the material to press down upon the overlapping portions of a formliner in order to optimize the fit between overlapping portions and overlapped portions of adjacent formliners to thereby reduce any visible seaming between the formliners.

Referring still to FIG. 3, the rib structure of the formliners 120, 122 can be generally defined by a semicylindrical or arch shape. Accordingly, the overlapping portions 144 and the overlapped portions 146 can be defined by a radius. In particular, a lower surface 160 of the overlapping portion 144 of the formliner 122 can be defined by a first radius. Similarly, an upper surface 162 of the overlapped portion 146 of the formliner 120 can be defined by a second radius. The first radius can be greater than the second radius in order to allow the overlapped portion 146 to be nested within the overlapping portion 144. As such, the overlapped portions 146 can define a smaller cross-sectional profile than the interior cavity of the overlapping portions 144.

Furthermore, although the rib structure is illustrated as being formed by semicylindrical or arch shaped channels, the rib structure can be formed by a rectangular cross-section. In this regard, any variety of shapes can be used. For example, while an embodiment of the formliners discussed herein is generally intended to create an appearance of faux brick, other embodiments of the formliners disclosed herein can be designed to create an appearance of faux stone, including any of various commercial stone such as cut stone, castle rock, sand stone, ledgestone, fieldstone, etc., as well as, wood, river rock, slate, or other materials and variations, which is merely an exemplary and non-limiting list of potential appearances and applications. Thus, the rib structure can be varied and diverse. The dimensions of the rib structure can be variable and allow for irregular patterns as may be seen in natural settings of stone, brick, wood, or other materials.

In addition, referring again to FIG. 1, the formliner 100 can comprise a plurality of rib openings 180. The rib openings 180 can be positioned along the ribs 102 of the rib structure of the formliner 100. The location of the openings 180 can correspond to a location of a corresponding rib of another formliner to which the formliner 100 is interconnected. The rib openings 180 can facilitate precise alignment of a plurality of formliners. Further, the rib openings 180 can further contribute to the natural appearance of the faux brick pattern created in the concrete structure. The formation and configuration of rib openings 180 is shown and described further below.

Figure 4:
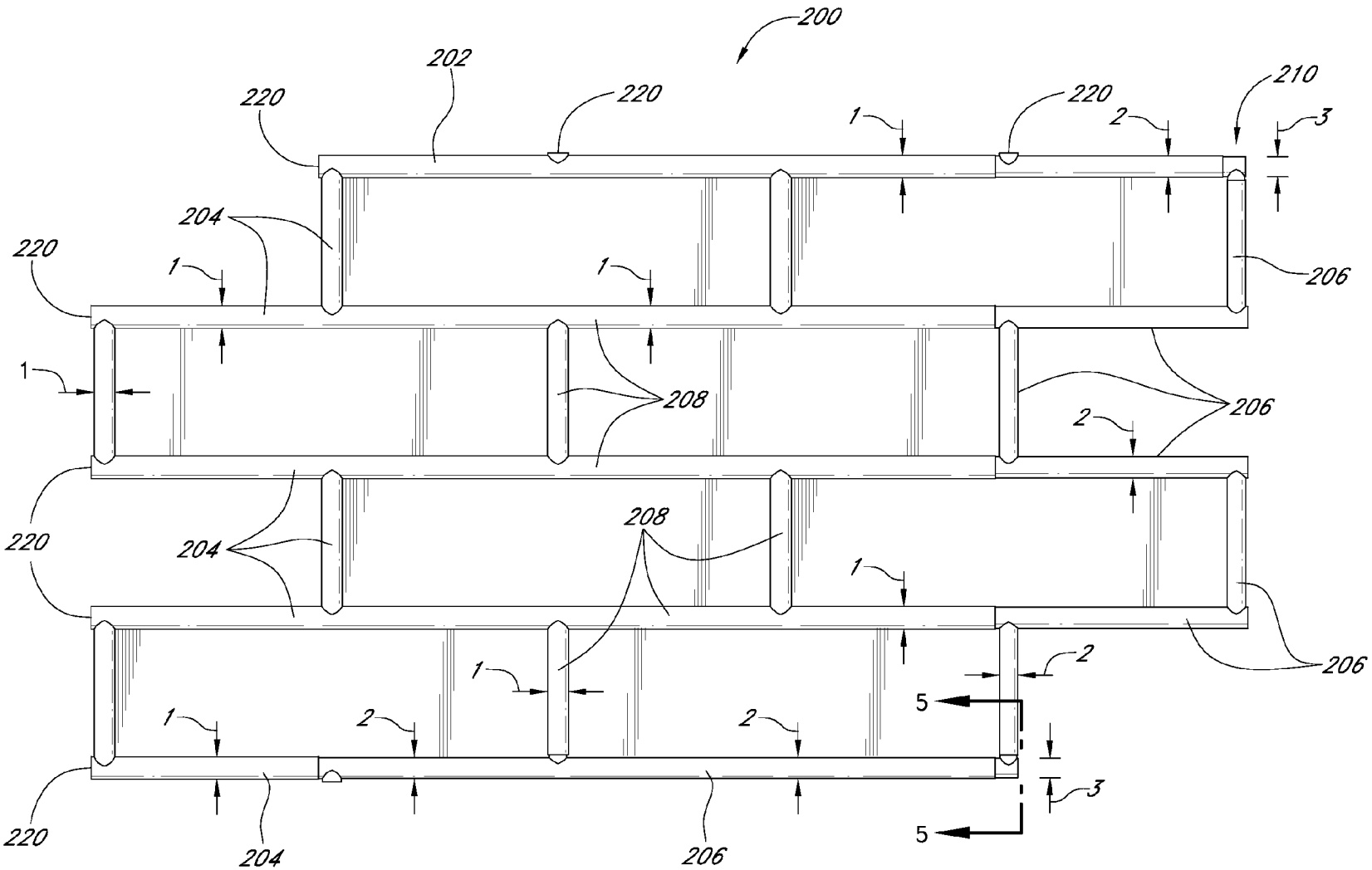
FIG. 4 is a top view of a formliner, according to an embodiment.

FIG. 4 is a top view of a formliner 200 in accordance with an embodiment. As with the formliner 100, the formliner 200 comprises a plurality of ribs 202 that form a ribs structure. The ribs 202 can comprise one or more overlapping portions 204 and one or more overlapped portions 206. Additionally, the formliner 200 can comprise non-overlap portions 208. The embodiment of FIG. 4 illustrates that the overlapping portions 204 and the non-overlap portions 208 can define a common outer dimension 1. Thus, when a plurality of the formliners 200 are interconnected, the overlapping portions 204 overlap with the overlapped portions 206 and the resulting rib structure of the interconnected formliners has a common outer dimension 1.

In this regard, as discussed above, the overlapped portions 206 can define an outer dimension 2. The outer dimension 2 can be less than the outer dimension 1. Further, an inner dimension of the overlapping portions 204 can also be greater than the outer dimension 2 of the overlapped portions 206.

Moreover, it is contemplated that in using a formliner that defines a generally rectangular perimeter, there may be sections of interconnected formliners in which more than two formliners overlap. Accordingly, in some embodiments, the formliner 200 can be configured to define a sub-overlapped section 210. As illustrated in the upper and lower right corners of the formliner 200, the sub-overlapped sections 210 can define an outer dimension 3. The outer dimension 3 can be less than the outer dimension 2 and the outer dimension 1. Further, and inner dimension of the overlapped portions 206 can also be greater than the outer dimension 3 of the sub-overlapped portions 210. Additionally, as described above with respect to FIG. 1, the formliner 200 can also be configured to include a plurality of rib openings 220. As similarly described above, the plurality of rib openings 220 can be located and configured to correspond with corresponding ribs of adjacent interconnected formliners.

In this manner, a single formliner can be used to create a continuous decorative pattern that can be used for any size concrete structure. Advantageously, in contrast to prior art formliners, embodiments of the formliners disclosed herein can be interconnected to create a dimensionally continuous, precise assembly of formliners.

Figure 5:
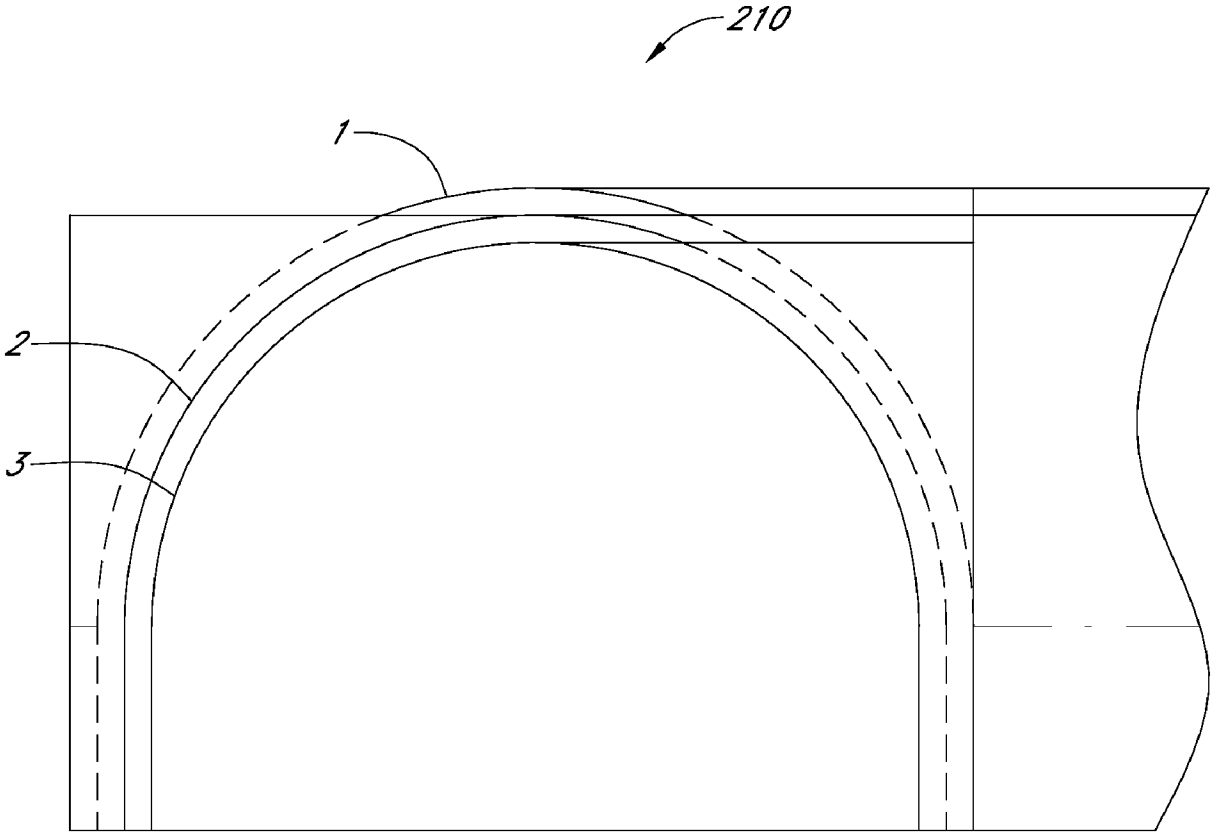
FIG. 5 is an end view taken along section 5-5 of FIG. 4.

Referring now to FIG. 5, an end view of the sub-overlapped section 210 of FIG. 4 is illustrated. As shown, the sub-overlapped section 210 defines an outer dimension 3 that is less than the outer dimension 2 of the overlapped section 206 (shown in dashed lines). Additionally, the outer dimension 1 of the overlapping sections 204 is also shown dashed lines and illustrated as being greater than both the outer dimension 2 and the outer dimension 3.

Figure 6:
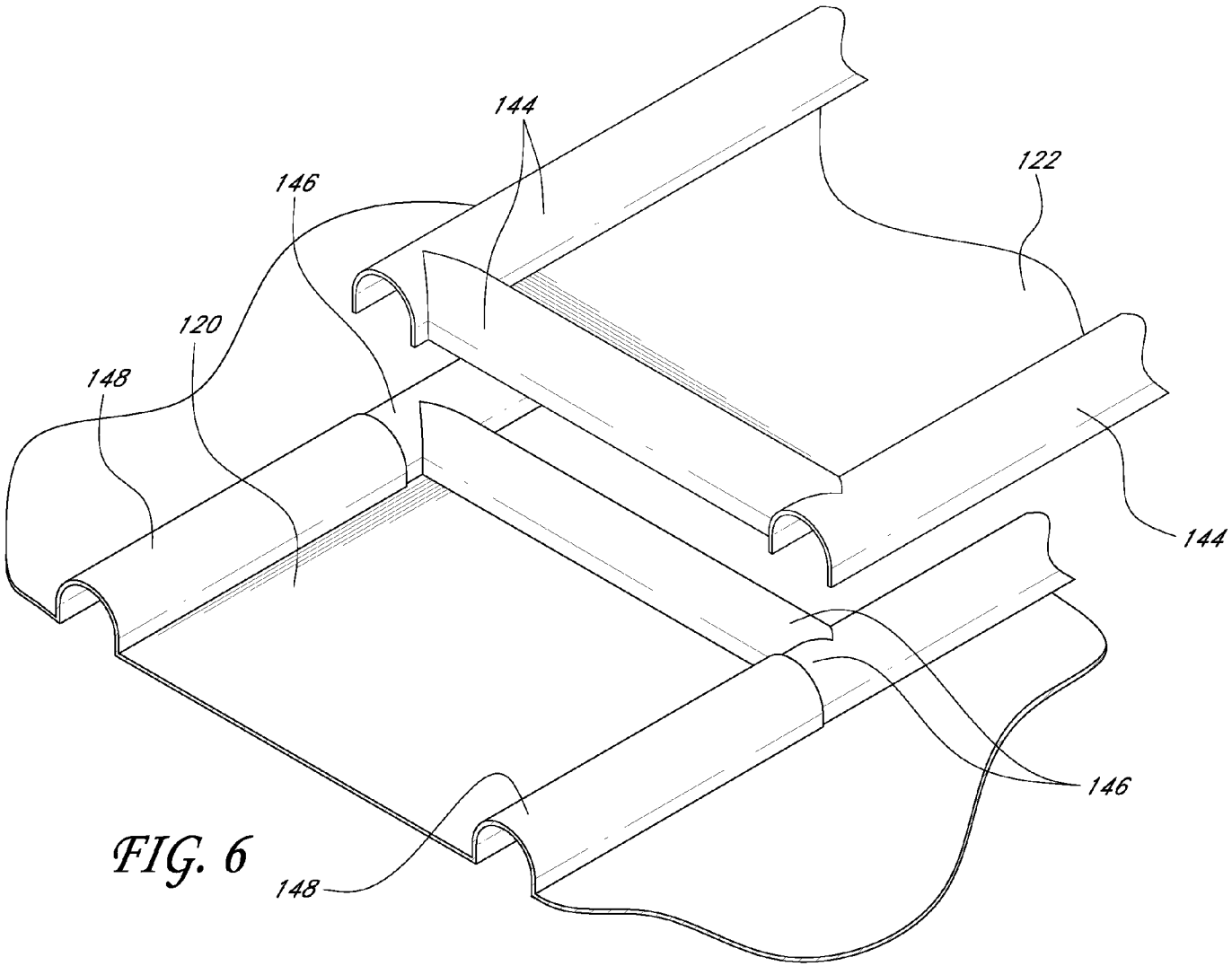
FIG. 6 is a perspective view of first and second formliners as the first formliner is overlaid onto the second formliner, according to an embodiment.

FIG. 6 is a perspective view of the formliner assembly of FIG. 2. In particular, the formliner 122 and the formliner 120 are shown in a pre-assembled state. In this regard, FIG. 6 illustrates that the overlapped sections 146 of the formliner 120 are received within cavities of the overlapping sections 144 of the formliner 122. As discussed below in reference to FIG. 10, the upper surfaces of the overlapping sections 144 of the formliner 122 can be generally flush with the upper surfaces of non-overlap sections 148 of the formliner 120.

Figure 7:
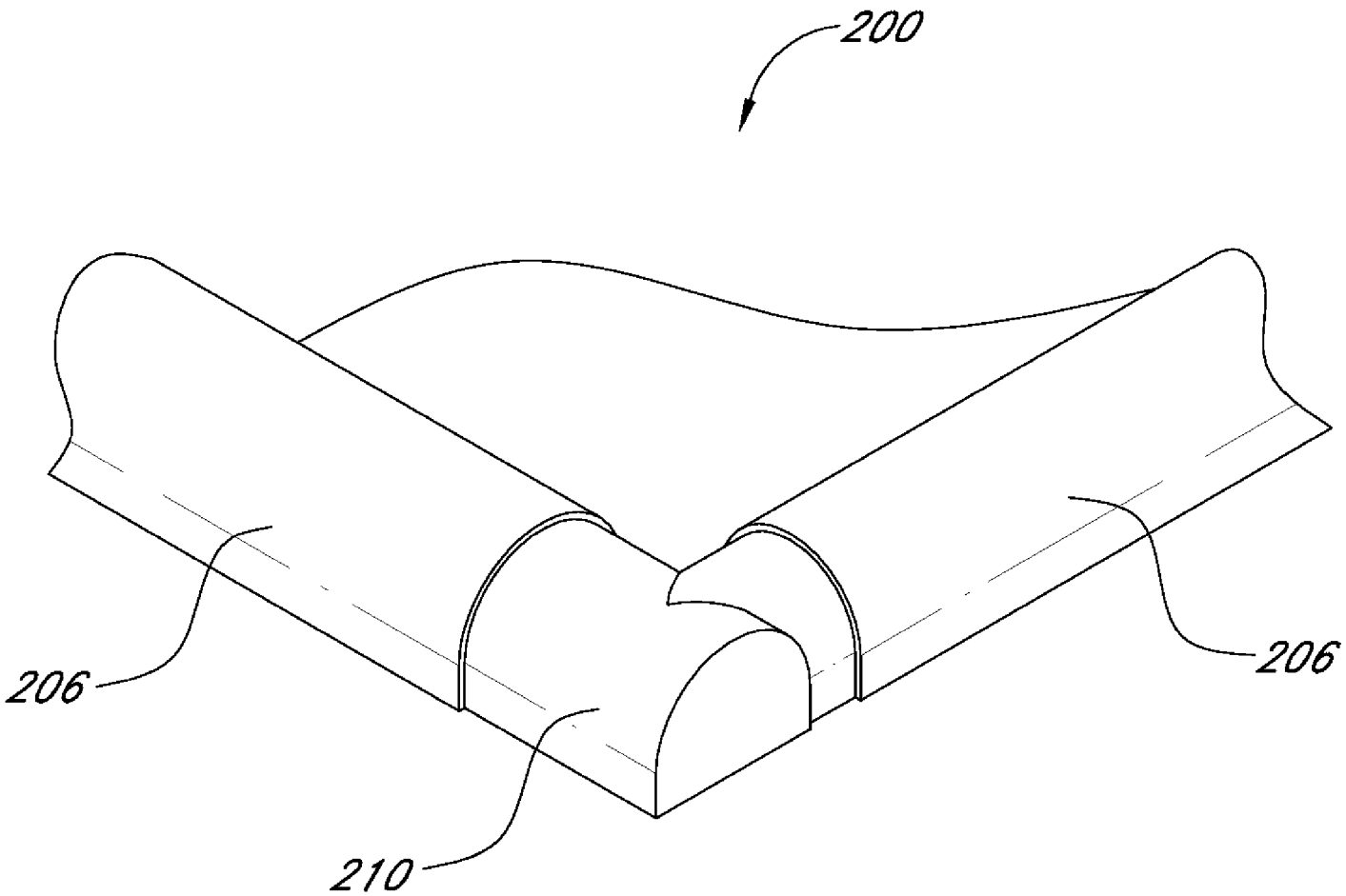
FIG. 7 is an enlarged perspective view of a rib corner of the formliner shown in FIG. 4.

FIG. 7 is a partial perspective view of the formliner 200, illustrating the sub-overlapped portion 210 thereof. As shown, the sub-overlapped portion 210 defines a smaller cross-sectional profile or dimension than the overlapped portion 206.

Figure 8:
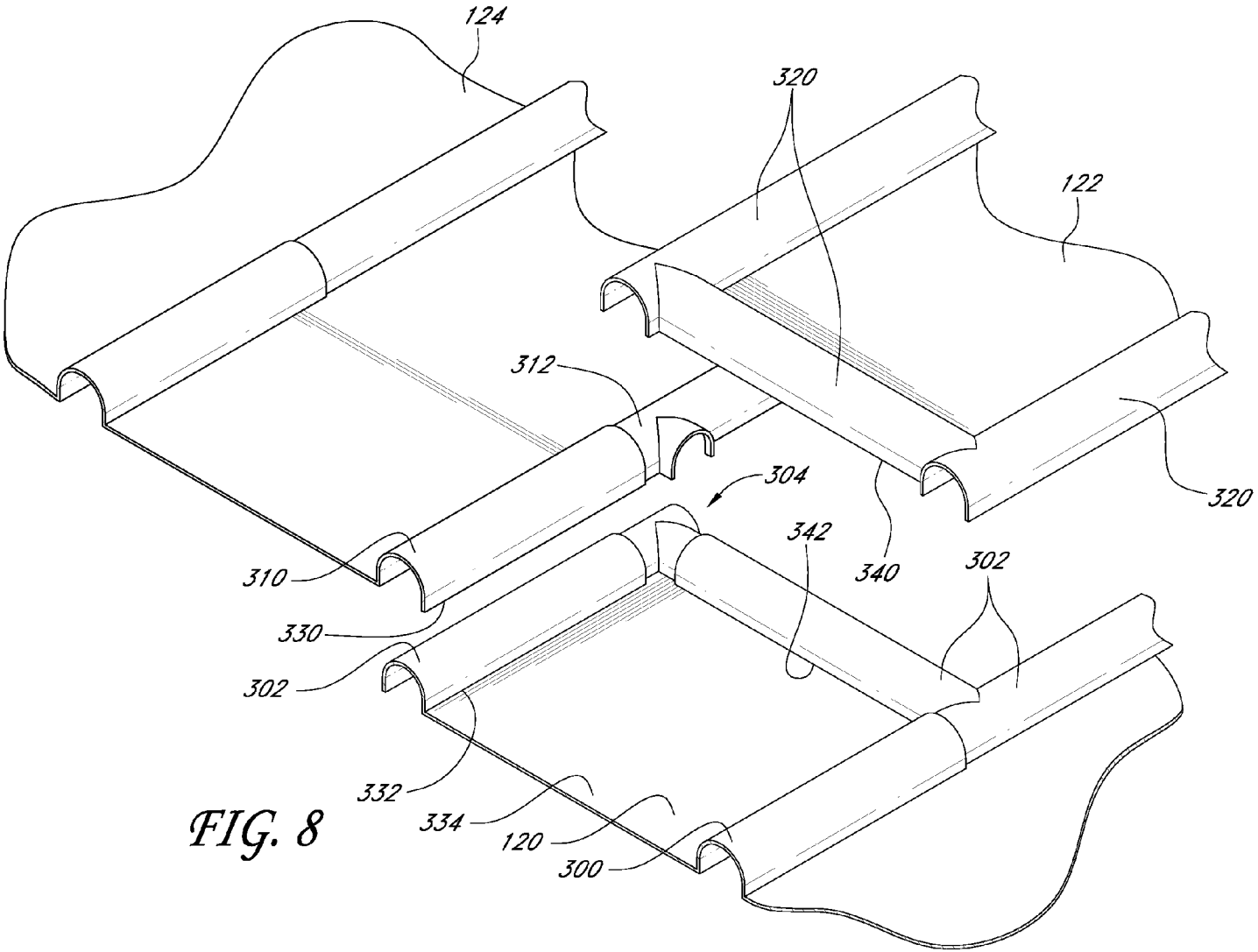
FIG. 8 is a perspective view of a first formliner, a second formliner, and a third formliner illustrating nesting of the formliners along a rib corner of the first formliner, according to an embodiment.

FIG. 8 is a perspective view of the formliner assembly of FIG. 2 illustrating the formliners 120, 122, and 124. In this view, the ribs structure of the formliner 120 comprises overlapping portions 300, overlapped portions 302, and a sub-overlapped portion 304. The formliner 124 is first placed onto the overlapped portion 302 of the formliner 120. As can be appreciated, an overlapping portion 310 of the formliner 124 is placed onto an overlapped portion 302 of the formliner 120. Additionally, an overlapped portion 312 (shown as a T-connection) of the formliner 124 is placed onto the sub-overlapped portion 304 of the formliner 120. Finally, overlapping portions 320 of the formliner 122 are placed onto the overlapped portions 302 of the formliner 120 and the overlapped portion 312 of the formliner 124. Once assembled, the overlapping portions 300, 310, and 320 each define a common outer dimension or shape. Thus, when the formliner assembly is pressed into an exposed surface of fresh concrete or when concrete is poured thereagainst, the impressions of the rib structure of the formliner assembly will appear seamless and uniform.

In addition, as will be appreciated, once the formliners 120, 122, and 124 are assembled, an edge 330 of the overlapping portion 310 of the formliner 124 will be disposed into a corner 332 formed between the overlapped portion 302 and a cell 334 of the formliner 120. As such, any seaming between the overlapping portion 310 of the formliner 124 and the cell 334 of the formliner 120 will be reduced and/or eliminated.

Similarly, an edge 340 of the overlapping portion 320 of the formliner 122 will be disposed into a corner 342 formed by the overlapped portion 302 and the cell 334. Thus, seaming between the formliner 120 and formliner 122 will be greatly reduced and/or eliminated.

Figure 9:
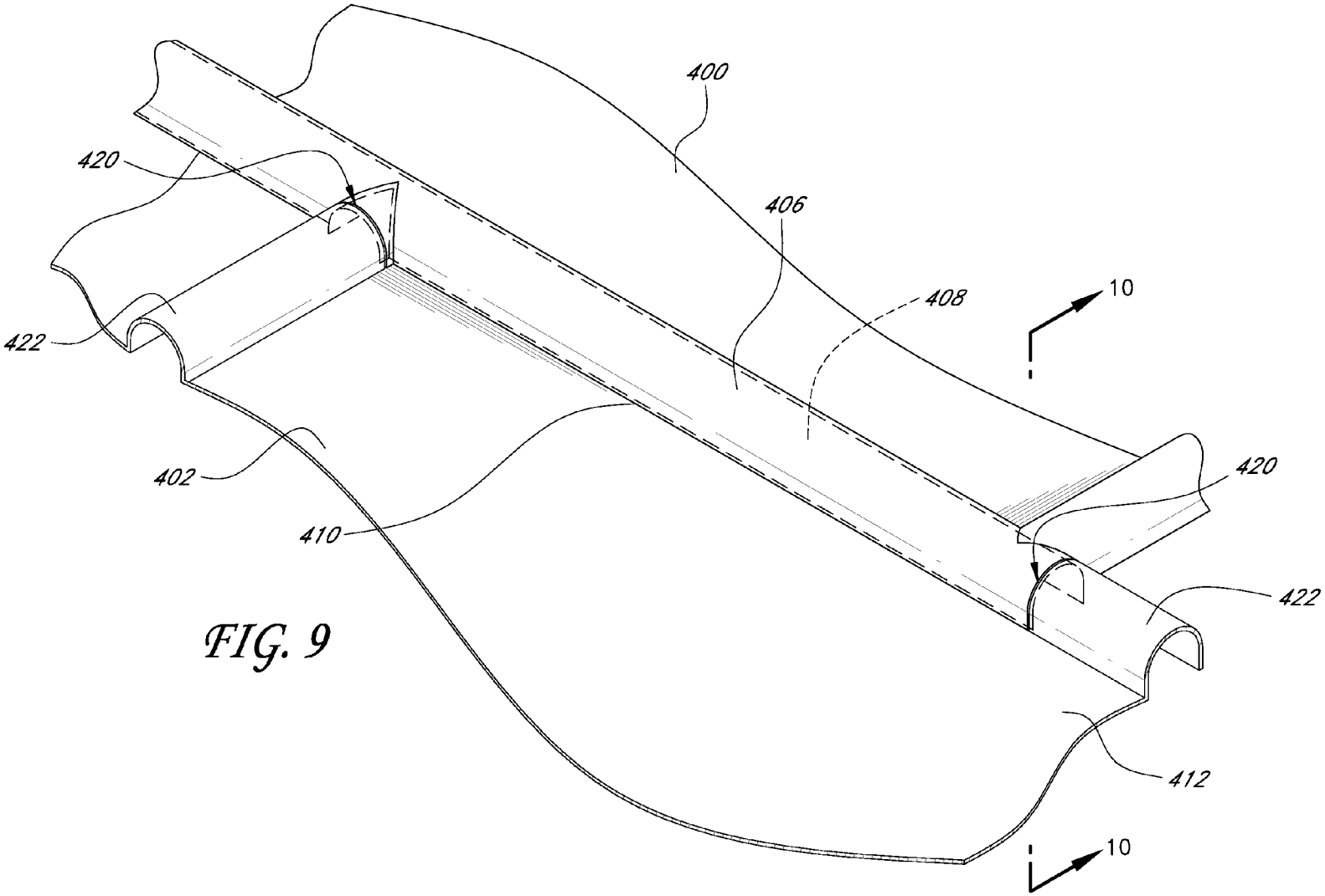
FIG. 9 is a perspective view of first and second formliners in an interconnected configuration, according to an embodiment.

FIG. 9 illustrates many of the above-discussed principles. In this figure, a first formliner 400 is mated with a second formliner 402. And overlapping portion 406 of the first formliner 400 is placed onto an overlapped portion 408 of the second formliner 402. As discussed above with respect to FIG. 8, the mating of an edge 410 of the overlapping portion 406 with 412 of the second formliner 402 can create an imperceptible seam between the first and second formliners 400, 402. Further, transition zones or joints 420 between the overlapping portion 406 of the first formliner 400 and an overlapping portion 422 of the second formliner 402 can be minimized so as to reduce and/or eliminate any visible seaming at the transition zones or joints 420.

Figure 10:
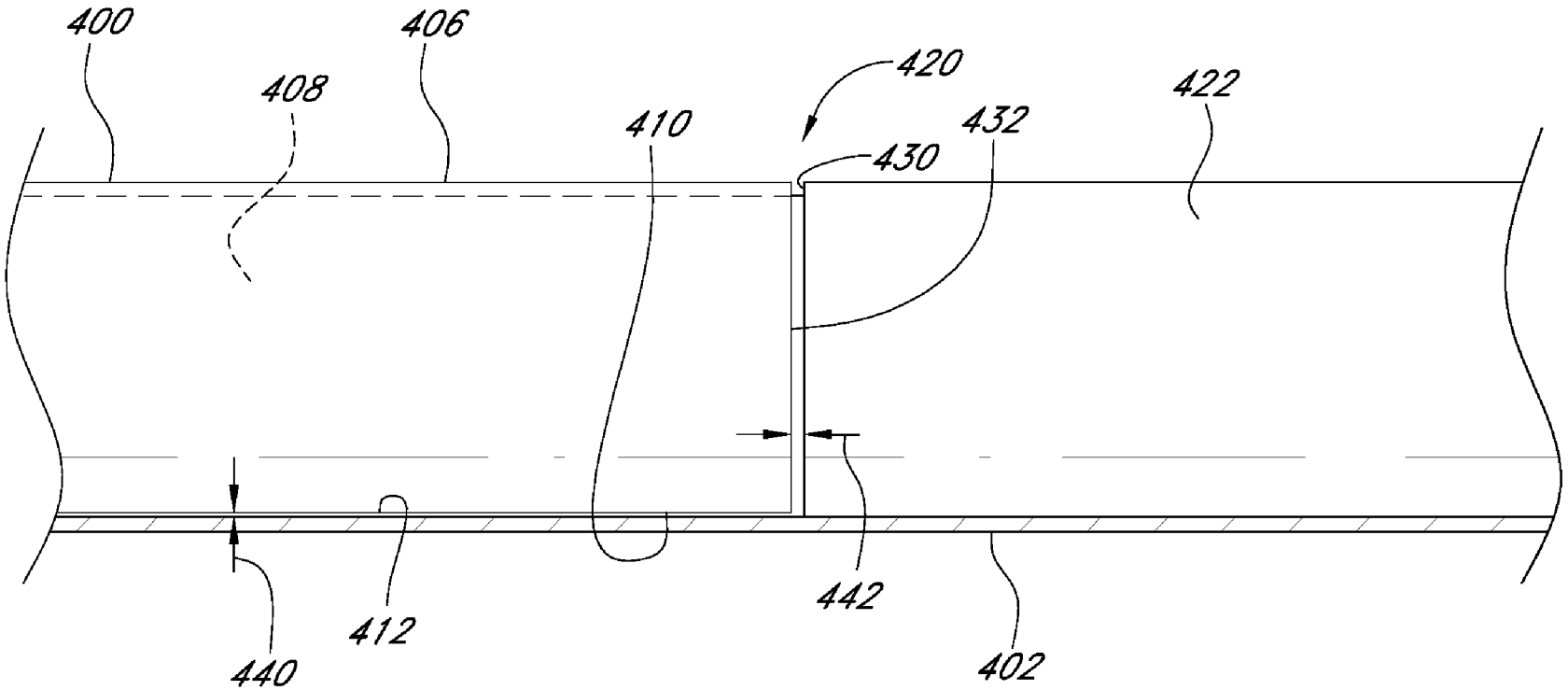
FIG. 10 is a cross-sectional side view of the first and second formliners shown in FIG. 9 illustrating flush exterior surfaces of the first and second formliners.

Referring now to FIG. 10, an enlarged view of a transition zone or joint 420 of FIG. 9 is illustrated. As shown, the transition zone or joint 420 can comprise a simple step 430 from a first dimension to a second dimension. In some embodiments, this may be an immediate increase in the dimension along the rib of the second formliner, specifically from the overlapped portion 408 to the overlapping portion 422. However, in other embodiments, it is contemplated that the step 430 can be a tapered transition between the overlapped portion 408 in the overlapping portion 422. Additionally, a side edge 432 of the overlapping portion 406 of the first formliner 400 can be configured to correspond to the shape and dimension of the step 430.

Further, FIG. 10 also illustrates the nesting arrangement of the overlapping portion 406 of the first formliner 400 is shown with respect to the overlapped portion 408 of the second formliner 402. Finally, FIG. 10 also illustrates the orientation of the edge 410 of the overlapping portion 406 of the formliner 400 is shown with respect to the cell 412 of the second formliner 402.

With continued reference to FIG. 10, it will be appreciated that a seam 440 formed between the edge 410 and the cell 412 can be reduced as the fit between the first formliner 400 and the second formliner 402 are optimized. In this regard, the internal geometry of the overlapping portion 406 can be specifically configured to match the external geometry of the overlapped portion 408, thus reducing any seam (whether along the edge 410 or the side edge 432) between the overlapping portion 406 and the overlapped portion 408.

As noted above, one of the advantages of embodiments disclosed herein is that seams of overlapped portions of adjacent formliners can be minimized and/or eliminated. In this regard, as illustrated in FIG. 10, the seam 440 is created along a corner at or along a bottom portion of the cell 412 of the formliner 402 which forms part of a prepared formliner mold cavity. In this regard, the seam 440 is positioned such that the weight of a curable material, such as concrete, against the first formliner 400 causes the overlapping portion 406 of the first formliner 400 to be pressed against the overlapped portion 408 of the second formliner 402 with great force thereby causing the edge 410 to be positioned as close as possible relative to the cell 412 in order to minimize and/or eliminate the seam 440 between the adjacent formliners 400, 402. This innovative feature of embodiments disclosed herein, which allows seams to be created along the bottom faces or portions of the mold allows the weight of the curable material to act as a compressive agent in reducing and/or eliminating seams between adjacent formliners. For example, a common curable material such as concrete generally weighs 150 pounds per cubic foot, and embodiments of the present inventions are able to take advantage of the significant force of such a material in order to create an aesthetically superior product.

Furthermore, the tolerances between the overlapping portion 406 and the overlapped portion 408 can also define a seam 442. Specifically, the distance between the edge 432 and the step 430 can define the seam 442. It is contemplated that the overlapping portion 406 can be toleranced with a longitudinal length such that the edge 432 thereof abuts the step 430. It is also contemplated that as with the seam 440, the compressive forces of the material against the first formliner 400 and the second formliner 402 can serve to reduce the size of the seam 442 to thereby create a superior finished product.

Referring now to FIGS. 1-10, it is noted that the above-discussed embodiments of the formliner and formliner components provide for a distinct shelf or step between rib sections having differing geometries or configurations. For example, as noted above with respect to FIG. 10, the step 430 is a transition zone, shelf, or shoulder between the overlapping portion 422 and the overlapped portion 408 of the second formliner 402. as briefly mentioned above, the step 430 can provide a gradual transition from the overlapping portion 422 to the overlapped portion 408. however, in some embodiments, it is contemplated that the formliner can be formed with ribs or ridges that taper from a first geometry or configuration to a second geometry or configuration. As such, the shoulder 430 can be eliminated from such embodiments.

For example, referring generally to a side view similar to that of FIG. 10, it is contemplated that a rib can taper from a first dimension or configuration in an overlapping portion to a second dimension or configuration in an overlapped portion. In yet other embodiments, it is contemplated that the rib can taper from the second dimension or configuration to a third dimension or configuration. The tapering of the rib from one dimension to another can comprise a generally constant taper or a variable taper.

Further, in some embodiments, overlapping portions of the ribs of the formliner can be configured to define a variable thickness corresponding to the tapering of the overlapped portions onto which the overlapping portions will be overlaid. As such, the cumulative dimension or configuration of nested or overlaid rib portions can be generally constant. However, it is likewise contemplated that the thickness of overlapping or interconnecting formliners can be generally constant along their respective ribs or ridges.

Additionally, in accordance with at least one of the embodiments disclosed herein is the realization that in forming a pattern of interconnected formliners, the edges along the top, bottom, left, and right sides of a pattern or casting can be carefully arranged in order to ensure a natural appearance. Commonly, a plurality of formliners must be used in order to form a pattern or casting larger than a few square feet in size. Typically, in arranging or interconnecting the formliners, an artisan may begin from a top left corner and work down and across toward the bottom right corner. Thus, the left side and the top side of the pattern or casting can generally be comprised of whole or entire formliners that are interconnected vertically and horizontally. Additionally, formliners located in the center portions of the pattern or casting are also whole or entire formliners. However, according to at least one of the embodiments disclosed herein is the realization that formliners located along the bottom and right sides of the pattern or casting may only be partial sheets. In some embodiments, this deficiency can be overcome by providing alternative embodiments of a formliner that enable the artisan to create desirable bottom and right side edges and/or that can be interconnected with other formliners along a partial length thereof in order to form a clean edge, whether it is a straight edge, curved edge, angled edge, or otherwise.

Figure 11:
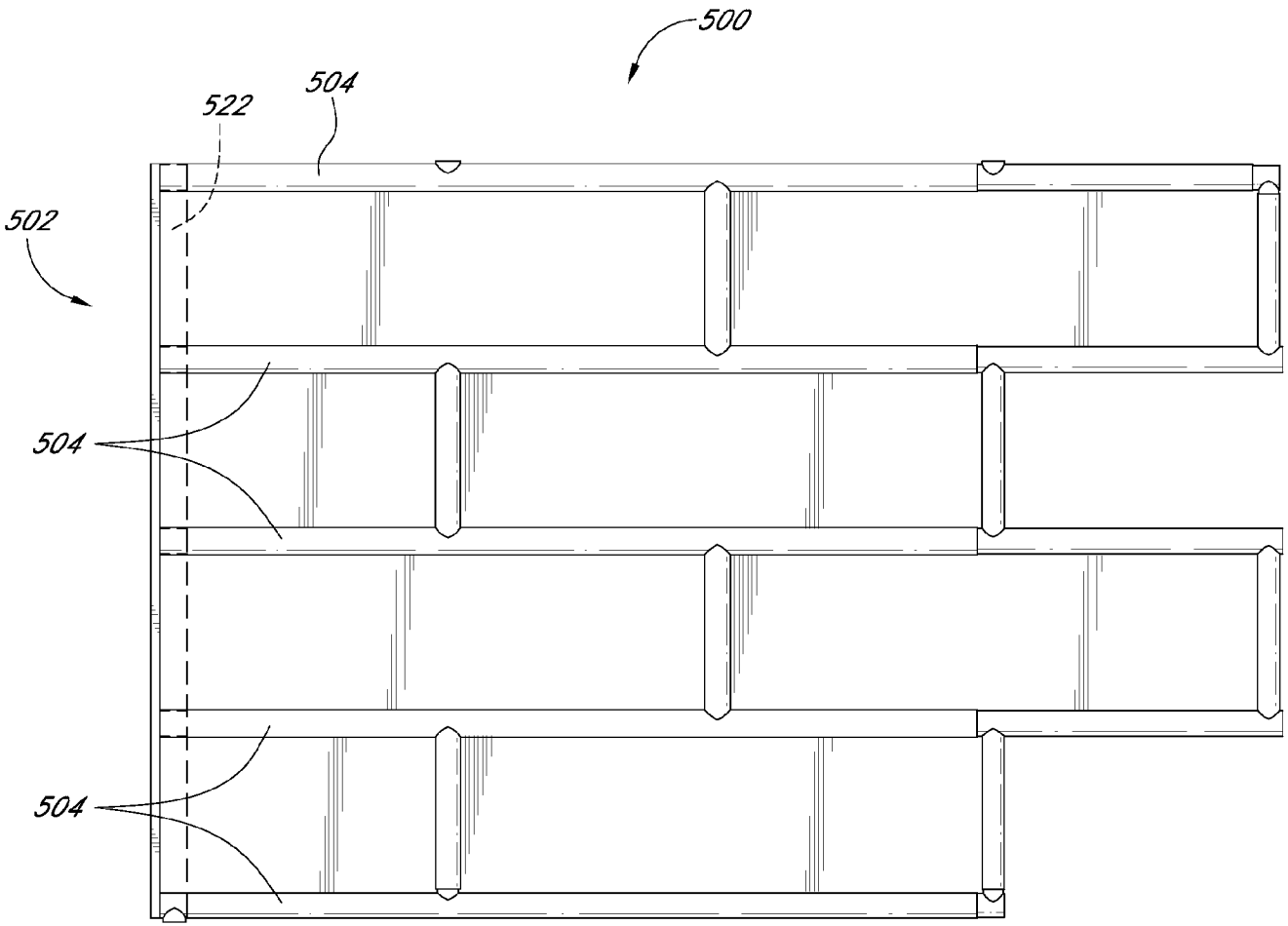
FIG. 11 is a top view of a formliner for forming a mold corner, according to another embodiment.

Accordingly, referring to FIGS. 11-14, alternative formliner embodiments are shown. In FIG. 11, a formliner end portion 500 is shown. The formliner end portion 500 can comprise many of the same features as discussed above with respect to the other formliner embodiments. However, the formliner end portion 500 can also optionally comprise a generally straight side 502 that is configured to mate with a corresponding formliner end portion. In this regard, it is contemplated that in use, the formliner end portion 500 can be used at a far side or end of the desired pattern. For example, the formliner end portion 500 can be used for a left side boundary or a right side boundary.

In some embodiments, the formliner end portion 500 can be configured to mate with another formliner to form a corner of a pattern, casting, or formwork. In such an embodiment, the formliner end portion 500 can also optionally comprise a ledge recess 522, as described below. For example, the ledge recess 522 can be forwarded by a length of the ribs 504 which comprises a reduced geometry or dimension, as shown in dashed lines in FIG. 11. Accordingly, some embodiments of the formliner end portion 500 can be provided in which the side 502 can mate with corresponding formliner components or portions.

Figure 12:
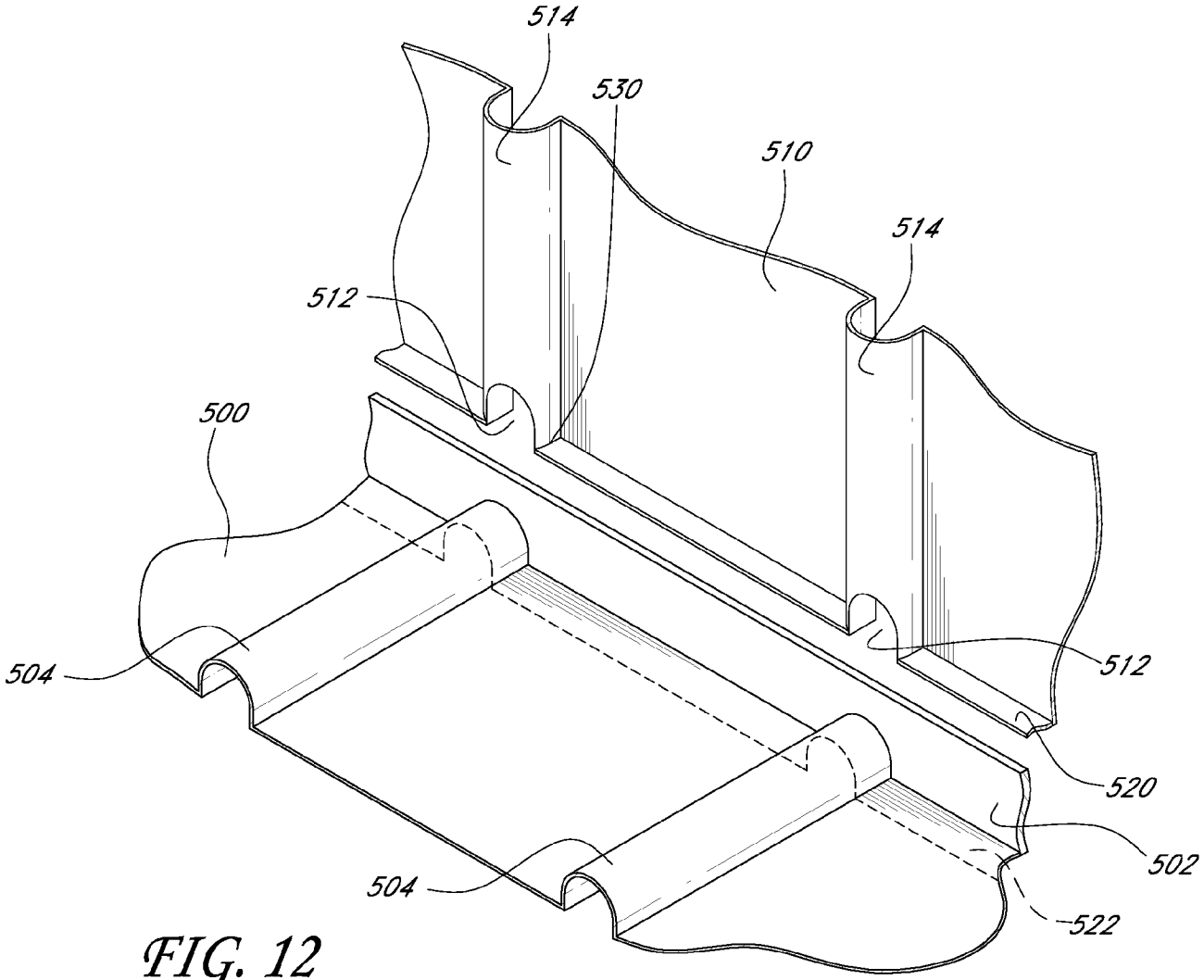
FIG. 12 is a perspective view of first and second formliners configured to form a mold corner, according to an embodiment.

For example, an exemplary mating arrangement of the formliner end portion 500 with a formliner component or portion is illustrated in FIG. 12. As shown therein, the formliner end portion 500 can receive a corresponding formliner end portion 510. The formliner end portion 500 and the corresponding formliner end portion 510 can be interconnected or positioned such that they form a corner in a pattern, casting, or formwork.

In accordance with the embodiments of the formliner end portion 500 and the corresponding formliner end portion 510 illustrated in FIG. 12, the corresponding formliner end portion 510 can define a plurality of recesses 512 formed at the ends of rib members 514. The recesses 512 can be configured to allow the rib members 514 to fit over the ribs 504 of the formliner end portion 500. Thus, the formliner end portion 500 and the corresponding formliner end portion 510 can be positioned relative to each other at a right angle such that a right angle corner in the pattern or casting is produced. However, it is contemplated that the recesses 512 can define other shapes that allowed the corresponding formliner end portion 510 to be oriented at any variety of angles relative to the formliner end portion 500. In this regard, the side 502 can be oriented generally perpendicularly relative to the ribs 504, or the side 502 can be disposed at an angle relative to the ribs 504, thereby facilitating a desired angular interconnection between the formliner end portion 500 and the corresponding formliner and portion 510.

Additionally, in the embodiments illustrated in FIG. 12, the corresponding formliner end portion 510 can also comprise a mating ledge 520. In some embodiments, the mating ledge 520 can be connected to both the ribs 514 and the planar portions of the cells above the corresponding formliner end portion 510. As such, the mating ledge 520 could be generally rigidly positioned relative to the ribs 514. Such an embodiment could be advantageous in facilitating the alignment between the formliner end portion 500 and the corresponding formliner end portion 510. In this regard, as mentioned above with respect to the side 502, the mating ledge 520 can be oriented at a given angle relative to the ribs 514. As illustrated, the mating ledge 520 can be oriented at approximately a right angle relative to the ribs 514. However, it is contemplated that the mating ledge 520 can also be oriented at any variety of angles relative to the ribs 514. In some embodiments, the mating ledge 520 can be configured to fit into or be received in the ledge recess 522 formed along the formliner and portion 500.

However, in other embodiments, the mating ledge 520 can be hingedly or moveably attached to the corresponding formliner end portion 510. For example, the mating ledge 520 can be attached to the corresponding formliner end portion 510 along the length of the cells thereof, but not connected to the ribs 514. In other words, the mating ledge 520 can be separated or cut from the ribs 514 by means of a slit 530. Thus, the slit 530 can allow the mating ledge 520 to be generally flexible or movable relative to the corresponding formliner end portion 510. In such embodiments, the mating ledge 520 can be folded under a portion of the formliner end portion 500. Optionally, the side 502 of the formliner and portion 500 can be eliminated in order to allow the mating ledge 520 to extend to underneath the formliner end portion 500.

Figure 13:
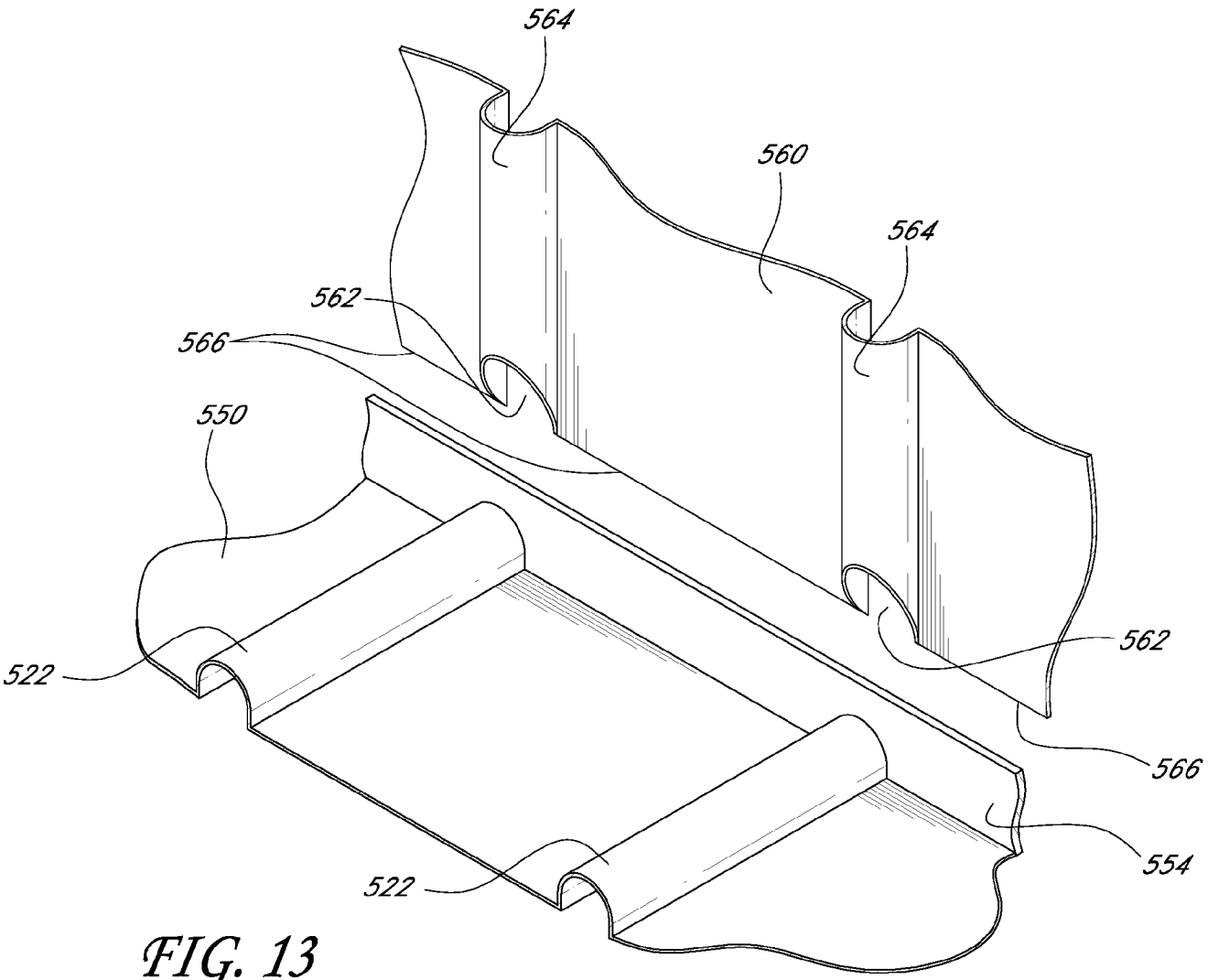
FIG. 13 is a perspective view of first and second formliners configured to form a mold corner, according to another embodiment.

However, in other embodiments, such as that illustrated in FIG. 13, it is contemplated that the ledge recess can be eliminated and that the ribs define a generally constant cross-sectional geometry. For example, the cross-sectional geometry of the ribs can be generally constant along central portions and end portions of the ribs adjacent the side of the formliner end portion.

Referring to FIG. 13, a formliner end portion 550 can comprise one or more ribs 552. Optionally, the formliner end portion can also comprise a side 554. However, as described above, the side 554 can also be eliminated in some embodiments. Additionally, the corresponding formliner end portion 560 can be configured to mate with the formliner end portion 550. The embodiment of the corresponding formliner and portion 560 does not include the mating ledge of the embodiment discussed in regard to FIG. 12. As will be appreciated with reference to FIG. 13, openings 562 in ribs 564 of the corresponding formliner end portion 560 can be mated against the ribs 522 of the formliner end portion 550 to create a corner of a desired angle measurement for a pattern or casting. Further, the openings 562 are preferably configured such that an edge 566 of the corresponding formliner end portion 560 can be positioned against the top surface of the cells of the formliner end portion 550. Optionally, the openings 562 can be configured to be manipulated in order to allow varying angles of orientation between the formliner end portion 550 and the corresponding formliner end portion 560. For example, a portion of the ribs 564 can be configured as a "tear away" that allows the openings 562 to be enlarged. The embodiment of FIG. 13 can facilitate a tight fit between the formliner end portion 550 and the corresponding formliner end portion 560.

Figure 14:
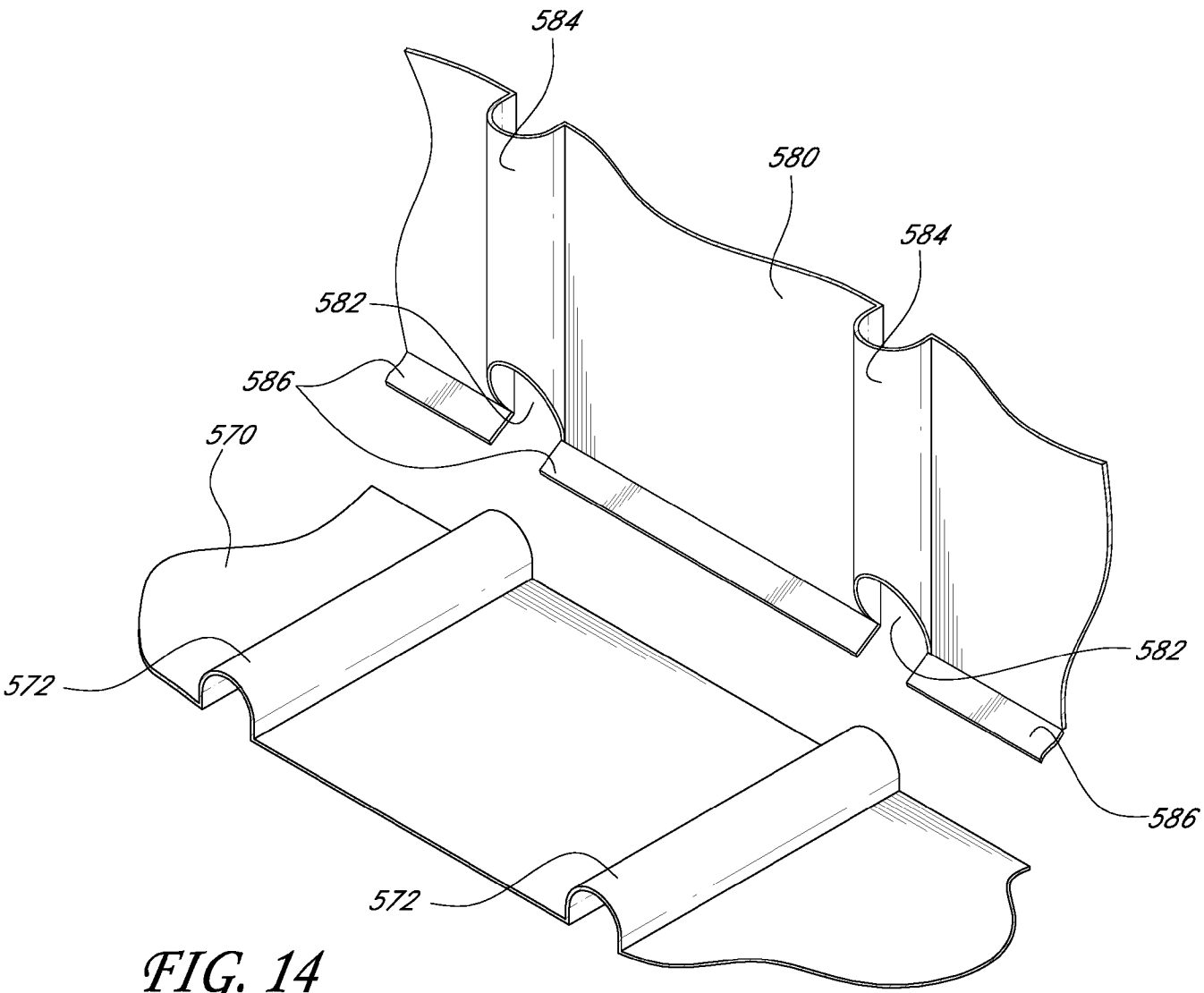
FIG. 14 is a perspective view of first and second formliners configured to form a mold corner, according to yet another embodiment.

Referring to FIG. 14, another embodiment of a formliner end portion 570 can be provided which comprises one or more ribs 572. As noted above, the formliner end portion 570 is an embodiment in which no side is used. Similar to the other embodiments disclosed herein, the formliner end portion 570 can be configured to mate with a corresponding formliner end portion 580. The embodiment of the corresponding formliner and portion 580 does not include the mating ledge of the embodiment discussed in regard to FIG. 12. As will be appreciated with reference to FIG. 14, openings 582 in ribs 584 of the corresponding formliner end portion 580 can be mated against the ribs 572 of the formliner end portion 570 to create a corner of a desired angle measurement for a pattern or casting.

Additionally, as illustrated in the embodiment of FIG. 14, the corresponding formliner end portion 580 can comprise a flange 586 extending from an edge thereof. The flange 586 can be monolithically formed with the corresponding formliner end portion 580. The flange 586 can be flexible relative to other portions of the corresponding formliner end portion 580. For example, the flange 586 can be folded underneath the formliner end portion 570 when the corresponding formliner end portion 580 is fitted onto the formliner end portion 570. In this manner, the corresponding formliner end portion 580 can be placed against and/or interconnected with the formliner end portion 570. Further, in some embodiments it is contemplated that the formliner end portion 570 and the corresponding formliner end portion 580 can be attached along the flange 586 by means of an adhesive. The embodiment of FIG. 14 can facilitate a tight fit between the formliner end portion 570 and the corresponding formliner end portion 580.

It is contemplated that the embodiment of FIGS. 11-14 can aid the artisan in creating a dimensionally accurate and seamless corner of a faux brick mold. It is contemplated also that other such features, such as three-point corners, convex arches, and concave arches can be formed using similar principles.

Figure 16:
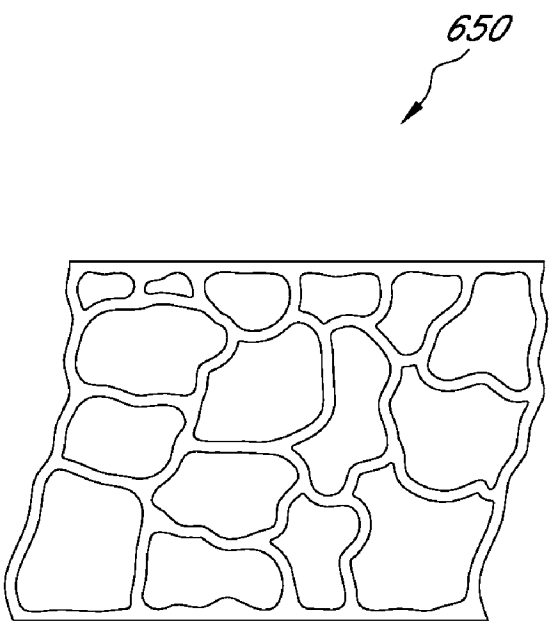
FIG. 16 is a top view of another alternative configuration of a formliner, according to another embodiment.
Figure 15:
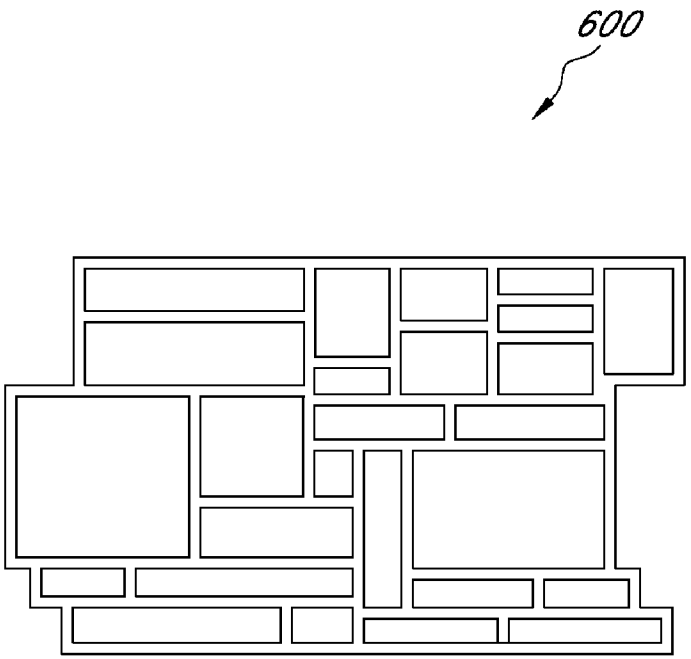
FIG. 15 is a top view of an alternative configuration of a formliner, according to an embodiment.

Further, FIGS. 15-16 illustrate other embodiments of a formliner, sheet, or panel having other shapes and geometries for imparting different patterns onto the treated or exposed surface. As discussed above, such patterns can be of stone, wood, slate, or other materials. FIG. 15 is a representation of a formliner 600 used to produce a stone pattern on an exposed surface six or 50. FIG. 16 is a representation of a formliner used to produce a rock pattern on an exposed surface.

Figure 17:
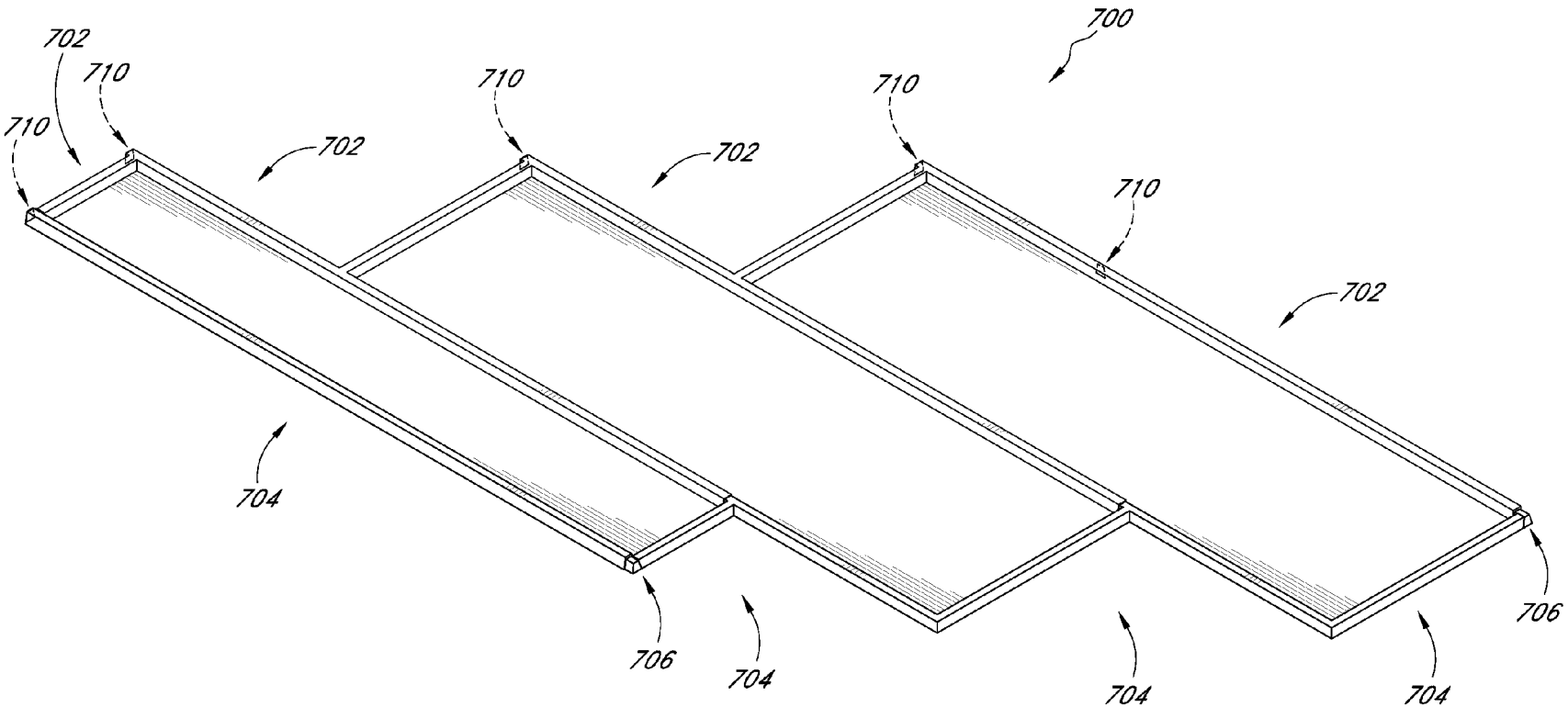
FIG. 17 is a perspective view of yet another alternative configuration of a formliner, according to another embodiment.

FIG. 17 illustrates yet another embodiment of a formliner, sheet, or panel 700 having a pattern configured to provide the appearance of cut stone. As shown therein, first rib portions 702 of the formliner 700 can be configured to define a first geometry or configuration, and second rib portions 704 can define a second geometry or configuration that corresponds to the first geometry or configuration and enables multiple formliners 700 to be interconnected along the rib portions 702, 704.

In some embodiments, the formliner 700 can comprise one or more third rib portions 706 that can define a third geometry or configuration that corresponds to one of the first and second geometries or configurations. For example, the first rib portion 702, the second rib portion 704, and the third rib portion 706 can allow the formliner 700 to be overlaid with other formliners 700 in a similar manner as to the formliner 100 described above, and as shown in FIGS. 2-10.

As mentioned above with respect to the embodiments disclosed in FIGS. 1-10, the first rib portions 702, the second rib portions 704, and the third read portions 706, can each comprise rib portions having a generally constant geometry or configuration, such as a cross-sectional geometry. However, it is also contemplated that the first rib portions 702, the second rib portions 704, and the third read portions 706 of the formliner 700 can taper from one geometry or configuration to another. In other words, the ribs or ridges of the formliner 700 can taper from the first geometry or configuration to the second geometry or configuration. In yet other embodiments, the ribs or ridges of the formliner 700 can also taper from the second geometry or configuration to the third geometry or configuration. The tapering in any such embodiment can be formed as a constant taper from one geometry or configuration to another, from one corner to another or along lengths of the ribs or ridges. The tapering in other embodiments can also be formed over discrete sections of the ribs or ridges. Accordingly, in such embodiments, the ribs or bridges can be formed without a distinct shelf or step from a given geometry or configuration to another geometry or configuration. Further, it is contemplated that overlapping portions of adjacent formliners can be configured to define variable thicknesses that taper along with the dimension or configuration of that portion of the ribs or ridges.

Finally, the formliner 700 can also comprise one or more openings 710 in one or more of the first, second, or third rib portions 702, 704, 706 in order to allow nesting and overlaying of the rib portions with each other, as similarly described above with respect to the embodiments shown in FIGS. 1-10. In this manner, a plurality of the formliners 700 can be used to create a desirable cut stone pattern while eliminating any appearance of seaming between the formliner 700.

Finally, in accordance with another embodiment, any of the embodiments of the formliner or combinations thereof can be used in a method of creating a decorative pattern on an exposed surface, such as a casting, whether vertical or horizontal, a wall, etc. The method can comprise assembling a plurality of any of the formliners disclosed herein to form an assembly. Further, a curable material can be positioned against the assembly, such as by pouring. In this manner, the seams between portions of adjacent formliners can be lessened due to the weight of the material. As the material cures, the seams between the adjacent formliners are reduced and/or eliminated compared to the prior art methods and formliners. As such, one may obtain an aesthetically superior product. Further, any of the embodiments herein provides the additional benefit that the artisan need not perform additional finishing steps to eliminate unsightly seams, thus resulting in a tremendous cost and time savings and efficiency.

Moreover, the formliners can be formed in any variety of shapes and the ribs or ridges formed in the formliners can serve to provide strength against the weight of the curable material positioned thereagainst without requiring that the formliner be exceedingly bulky, thick, or otherwise heavy. In this regard, embodiments of the formliner can advantageously be used, for example, in tilt-up assemblies that require heavy materials such as rebar without contributing significantly, if even much at all, to the overall weight of the assembly. As such, the formliners allow for the use of less rigorous machinery, such as smaller cranes, etc. Accordingly, the light weight of embodiments of the formliner can allow for additional reductions in cost, time, and labor.

As discussed above, embodiments of the formliners disclosed herein allows the artisan to eliminate and/or reduce any visible seaming between interconnected formliners. Some embodiments of the formliners disclosed herein are able to effectively eliminate such seaming by converging formliner edges into corners above an interconnected formliner and using tight tolerances in mating exposed surfaces of the interconnected formliners.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A formliner for use in creating a decorative pattern on an exposed face of cementitious material, the formliner comprising:

a sheet of material;

at least one cell formed in the sheet of material; and at least one rib extending along the cell and forming a boundary of the cell, the rib being formed in the sheet of material and defining a raised profile, the rib comprising:

a first section defining an exterior surface and an interior surface, the exterior surface of the first section of the rib being configured to face outwardly toward the cementitious material and to define a cross-sectional exterior profile, the first section further defining a recess adjacent to the interior surface thereof, the recess defining a cross-sectional interior profile;

a second section defining an exterior surface that defines a cross-sectional exterior profile, the cross-sectional exterior profile of the second section being less than the cross-sectional interior profile of the first section;

at least one opening formed in the first section; and a transition zone formed in the rib between the first section in the second section to interconnect the first section with the second section, the transition zone defining a variable cross-sectional exterior profile increasing from the cross-sectional exterior profile of the second section to the cross-sectional exterior profile of the first section;

wherein a first formliner can be interconnected with a second formliner by overlaying the first section of the rib of the first formliner onto the second section of the rib of the second formliner such that the second section of the rib of the second formliner is nested within the recess of the first section of the rib of the first formliner, and wherein exterior surfaces of the first sections of the ribs of the first formliner and the second formliner are flush with each other upon nesting of the second section of the second formliner within the first section of the first formliner, and wherein an opening in the first section of the first formliner mates against a transition zone of the second formliner such that visible seams in the decorative pattern are minimized when the first formliner and the second formliner are interconnected in use.

2. The formliner of claim 1, wherein the ribs of the first formliner and the second formliner are arcuately shaped.

3. The formliner of claim 1, wherein the opening formed in the first section of the rib extends from a base of the rib to an apex of the rib.

4. The formliner of claim 3, wherein the rib is arcuately shaped and the opening is curvilinear.

5. The formliner of claim 1, wherein a rib edge formed along the opening in the first section of the first formliner abuts the transition zone of the second formliner.

6. The formliner of claim 1, wherein the rib and the cell meet to form a corner.

7. The formliner of claim 6, wherein the first section of the rib of the first formliner defines a peripheral edge, the peripheral edge of the first section of the rib being disposed along a corner formed by the intersection of the rib and the cell of the second formliner along the second section of the rib of the second formliner.

8. The formliner of claim 7, wherein the peripheral edge of the first section of the rib is generally straight.

9. The formliner of claim 1, wherein the formliner comprises a plurality of cells with a plurality of ribs disposed intermediate the cells to form boundaries thereof.

10. The formliner of claim 9, wherein the cells define a generally rectangular shape.

11. The formliner of claim 10, wherein the cells define opposing narrow ends, the cells being arranged in a plurality of layers with each layer having a plurality of cells disposed end-to-end.

12. The formliner of claim 11, wherein the cells of a first layer are offset from the cells of a second layer.

13. The formliner of claim 11, wherein the formliner comprises a plurality of cells, the formliner defining a first end and a second end, the first end being formed to include a first finger joint pattern and the second end being formed to include a second finger joint pattern that is complementary to the first finger joint pattern such that a first end of the first formliner can be overlaid with a second end of the second formliner.

14. A panel for forming a repeated pattern on a rigid surface, the panel comprising:

a plurality of cells for receiving material to be applied to the surface and being arranged in rows with the cells of each row being offset with respect to cells of an adjacent row;

a panel periphery bounding the plurality of cells by a plurality of sides;

each cell comprising a recess portion for receiving the material and being shaped to confer a pattern on the material;

the panel periphery having a first section defining a recess and an opening and a second section configured to fit within the recess of the first section and extend through the opening such that a first formliner can be interconnected with a second formliner by overlaying the first section of the first formliner onto the second section of the second formliner, wherein exterior surfaces of the first sections of the first and second formliners on opposing sides of the opening are flush with each other upon the second formliner being nested in the first formliner; and a transition zone formed between the first section and the second section of the panel periphery to interconnect the first section with the second section, the transition zone defining a variable cross-sectional exterior profile increasing from a cross-sectional exterior profile of the second section to a cross-sectional exterior profile of the first section, wherein an opening in the first section of the first formliner mates against a transition zone of the second formliner such that visible seams in the decorative pattern are minimized when the first formliner and the second formliner are interconnected in use;

wherein at least one given side of the panel periphery is formed with cells in offset configuration such that the given side has at least one row with a projecting cell bounded in at least one adjacent row with a non-projecting cell.

15. The panel of claim 14, wherein the cells are uniformly sized.

16. The panel of claim 14, wherein the cells are rectangular.

17. The panel of claim 1, wherein the transition zone is formed at the intersection of transversely-extending ribs.

18. The panel of claim 14, wherein the periphery of the panel is defined by ridges formed around the cells.

19. The panel of claim 14, wherein the cells of the panel each define a perimeter, and the ridges extend around the entire perimeter of each cell.

20. The panel of claim 14, wherein the ridges of each panel comprise overlapping ridges and overlapped ridges, the overlapped ridges of a given panel being nestable within overlapping ridges of another panel.

21. The panel of claim 14, wherein the first section comprises ribs and the second section comprises ribs, wherein the ribs of the first and second sections are arcuately shaped and the opening formed in the first section is generally curvilinear.

* * * * *

UNITED STATES PATENT AND TRADEMARK OFFICE

CERTIFICATE OF CORRECTION

PATENT NO. : 7,963,499 B2
APPLICATION NO. : 12/238294
DATED : June 21, 2011
INVENTOR(S) : Edward Daniel Fitzgerald and Brian Eugene Sheehan It is certified that error appears in the above-identified patent and that said Letters Patent is hereby corrected as shown below:

Column 2, Line 63, please change “very” to --vary--.

Column 14, Line 3, please change “as” to --As--.

Column 14, Line 5, please change “however,” to --However,--.

Column 15, Line 34, please change “and portion” to --end portion--.

Column 15, Lines 52-53, please change “and portion” to --end portion--.

Column 15, Line 65, please change “and portion” to --end portion--.

Column 16, Lines 15-16, please change “and portion” to --end portion--.

Column 16, Line 41, please change “and portion” to --end portion--.

Signed and Sealed this
Thirteenth Day of March, 2012

David J. Kappos

David J. Kappos
*Director of the United States Patent and Trademark Office*